US008333916B2

(12) United States Patent
Jamrussamee et al.

(10) Patent No.: US 8,333,916 B2
(45) Date of Patent: Dec. 18, 2012

(54) APPARATUS AND METHOD FOR FORMING A PATTERN IN CERAMIC TILE OR SLAB WITH PRESCRIBED THICKNESS

(75) Inventors: Terdwong Jamrussamee, Pathumthani (TH); Arag Himtong, Nakhonsithamma (TH); Wittaya Chuajiw, Lampang (TH); Watthanakun Phabutta, Saraburi (TH)

(73) Assignee: SCG Building Materials Co., Ltd., Bangkok (TH)

( * ) Notice: Subject to any disclaimer, the term of this patent is extended or adjusted under 35 U.S.C. 154(b) by 564 days.

(21) Appl. No.: 11/859,684

(22) Filed: Sep. 21, 2007

(65) Prior Publication Data

US 2008/0079185 A1 Apr. 3, 2008

(30) Foreign Application Priority Data

Sep. 22, 2006 (TH) ..... 0601004683
Sep. 17, 2007 (EP) ..... 07116535

(51) Int. Cl.
*B28B 3/02* (2006.01)

(52) U.S. Cl. ..... 264/86; 264/71; 264/73; 264/74; 264/87; 264/129; 264/245; 264/309; 264/420; 264/490; 264/651; 264/DIG. 31; 425/44; 425/59; 425/86; 425/90; 425/99; 425/130; 425/134; 425/147; 425/183; 425/215; 425/218; 425/227; 425/256; 425/257; 425/375; 425/448; 425/587

(58) Field of Classification Search ..... 101/87, 101/171, 420, 490; 118/46; 137/505; 209/913; 210/224; 222/160, 162, 319; 239/650; 264/71, 264/73, 74, 86, 129, 245, 309, 651, 87, DIG. 31; 358/1.3; 425/44, 59, 86, 90, 99, 130, 134, 425/147, 183, 215, 218, 227, 256, 257, 375, 425/448, 587; 428/44; 438/692
See application file for complete search history.

(56) References Cited

U.S. PATENT DOCUMENTS 12,308 A * 1/1855 Brown ..... 239/650
(Continued)

FOREIGN PATENT DOCUMENTS

EP 1334811 A2 8/2003
(Continued)

OTHER PUBLICATIONS

Levitronix, "Point-of-Use Slurry Flow Control System", Apr. 14, 2004, http://www.levitronix.com/Documents/ApplicationNotes/PL-2024-03_Rev01_Point-of-Use_Slurry_Flow_Control_System.pdf.*

(Continued)

*Primary Examiner* — Katarzyna Wyrozebski Lee
*Assistant Examiner* — Joshel Rivera
(74) *Attorney, Agent, or Firm* — Steven L. Nichols; Van Cott, Bagley, Cornwall & McCarthy P.C.

(57) ABSTRACT

An apparatus for forming desired patterns on ceramic tile from a slurry comprising: a means for preparing a slurry; at least one slurry holding tank for holding at least one type of slurry; at least one pattern forming tray; at least one means for connecting said at least one tank to at least one pattern forming tray and a filter pressing unit; wherein the pattern forming unit dispenses a predetermined type, amount, colors of slurry at a predetermined order into the pattern forming tray to form a desired pattern, said slurry with desired pattern is pressed with the filter pressing unit to form ceramic tiles or slabs with a desired pattern running though its entire thickness.

37 Claims, 18 Drawing Sheets

U.S. PATENT DOCUMENTS

| | | | | | |
|---|---|---|---|---|---|
| 29,897 | A | * | 9/1860 | Mason | 239/668 |
| 1,330,717 | A | * | 2/1920 | Oelslager | 126/368.1 |
| 3,472,423 | A | * | 10/1969 | Kaplan | 222/129 |
| 3,478,969 | A | * | 11/1969 | Lund | 239/654 |
| 3,598,373 | A | * | 8/1971 | Inman | 264/5 |
| 3,838,001 | A | * | 9/1974 | Greiner et al. | 162/416 |
| 4,153,401 | A | * | 5/1979 | Longinotti | 425/134 |
| 4,266,921 | A | * | 5/1981 | Murray | 425/158 |
| 4,733,989 | A | * | 3/1988 | Harriett | 405/43 |
| 5,449,455 | A | * | 9/1995 | Womack | 210/224 |
| 5,558,773 | A | * | 9/1996 | Aigeldinger et al. | 210/770 |
| 5,795,513 | A | * | 8/1998 | Austin | 264/71 |
| 2007/0151623 | A1 | * | 7/2007 | Poole et al. | 141/83 |

FOREIGN PATENT DOCUMENTS

| | | | |
|---|---|---|---|
| EP | 1273408 | B1 | 9/2005 |
| WO | WO 2004/071733 | A1 | 8/2004 |

OTHER PUBLICATIONS

Perry, Green and Maloney, "Perry's Chemical Engineers Handbook", 1984, McGraw-Hill Book Company, Sixth Edition, 8-33 and 19-75.*

* cited by examiner

APPARATUS AND METHOD FOR FORMING A PATTERN IN CERAMIC TILE OR SLAB WITH PRESCRIBED THICKNESS

RELATED APPLICATIONS

Thai Patent Application No. 0601004683 filed on Sep. 22, 2006; European Patent Application No 07116535.1 filed on Sep. 17, 2007.

BACKGROUND

In the ceramic tiles industry, much effort is invested in developing technologies and methods for producing ceramic tiles with a desired pattern. The industry has moved from producing tiles with the desired pattern only on the top layer or only on the surface layer to producing tiles with the desired pattern running through the entire thickness of the tile.

One of the known methods of doing this is by loading dry soil powder inside a container and then discharging the content through the opening of discharging tubes attached to the container into a vertical compartment, forming layers of soil powder of different types and colors the vertical compartment. The vertical compartment is then rotated 90 degrees to transfer the layers of soil powder to a horizontal mold. The layers of soil power are then pressed together under high pressure, creating a ceramic tile. The various characteristics of the layers of different of soil powders, such as colors and texture, translate into the tile pattern. However, the problem associated with this method is that there are difficulties with controlling the amount of soil powder released into the compartment, resulting in an inability to regulate and vary the width of color band. Thus, the patterns that can be obtained are limited. In addition, the rotation of the vertical compartment causes the soil granules to shift, resulting in distortion of the pattern. Thus, the obtained tiles must be subjected to further surface treatment after firing to reveal the pattern.

European Patent No. EP1273408 and International Publication No. WO2004071733 disclosed a technique to make continuous veining of patterns extending through the entire thickness of tiles or slabs. However, there remains the possibility that materials on the surface layer will mix together, causing the desired pattern to be distorted. There has been, therefore, a necessity to remove those mixed materials at the surface layer by suction before pressing in order to obtain patterns that are visible without having to polish the upper surfaces of ceramic tiles after firing.

European Patent EP 1334811 disclosed a technique for making patterns throughout the mass of the ceramic tiles which is characterized by a double-pressing that comprises of first a low pressure compacting. The compacted ceramic tiles are subsequently decorated by an ink-jet system to apply, according to the design, special ceramic colors which can penetrate into the tile mass. This technique, however, results in patterns in the tile mass that are somewhat blurred or incomplete. Further, the penetration of the ceramic colors is not deep enough to create a pattern in the lower layers of the tile mass.

All the known methods and apparatuses above comprise the compacting of material in powdery form.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

The invention provides an apparatus and method for forming a pattern in ceramic tiles with prescribed thickness, wherein the pattern runs through the entire thickness of the tiles or slabs. The method of the invention provides the use of a material in slurry form instead of a material in powdery form. This method of forming a pattern in the ceramic tiles imitates natural rock formation, resulting in a pattern that closely resembles natural rock. The apparatus is equipped with means for controlling the deposition of a plurality of slurries to create predetermined or desired patterns. The means for controlling the deposition of the slurry can include controlling the position, amount, and order in which of the different types and different colors of slurry are deposited in a pattern receiving tray. The slurry is then pressed in a filter press unit to form a green ceramic slab ready for further decoration and firing.

Another objective of the invention is that by employing the apparatus according to the principles described herein, the tile or slab obtained will be of consistent thickness and size.

For the purposes of explanation, several embodiments of the apparatus and method according to the invention will be given by way of non-limiting examples. Therefore the apparatus and method are not limited only to the specific embodiments described herein.

We will first describe the apparatus and then the method.

Figure 1:
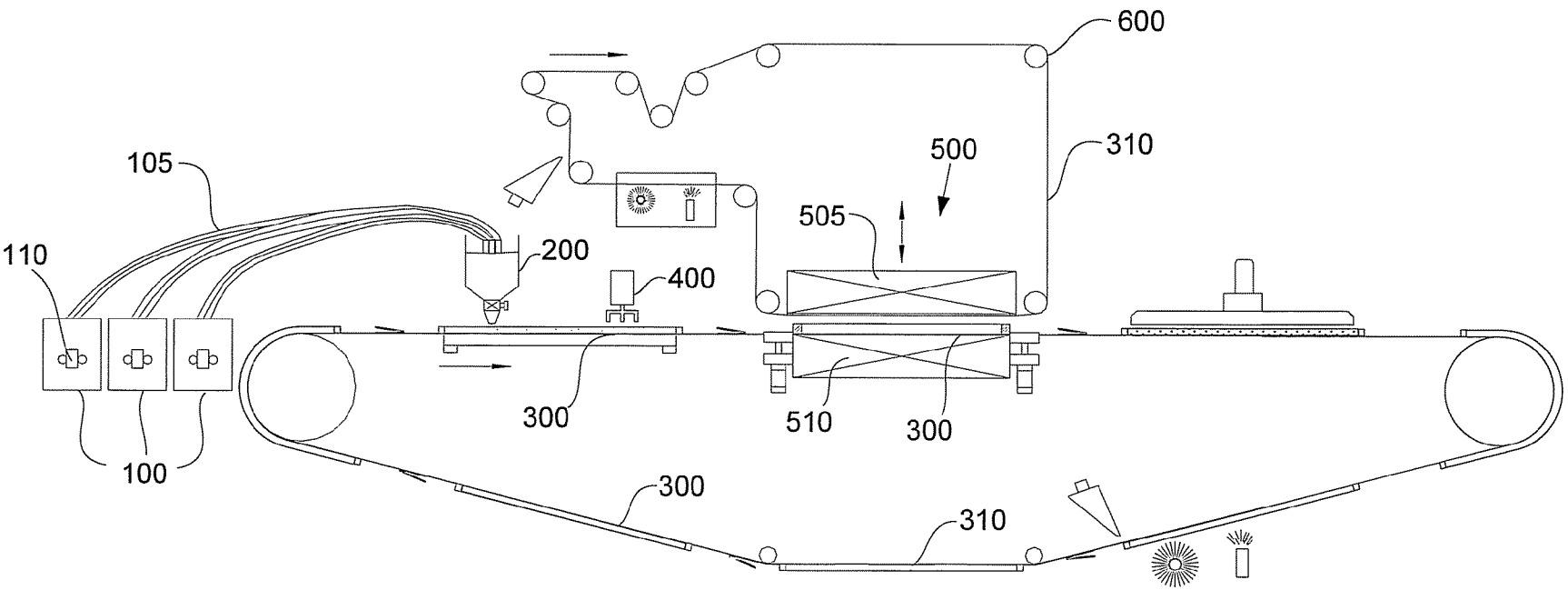
FIG. 1 shows side view of one exemplary embodiment of an apparatus for forming ceramic tiles, according to principles described herein.
Figure 2:
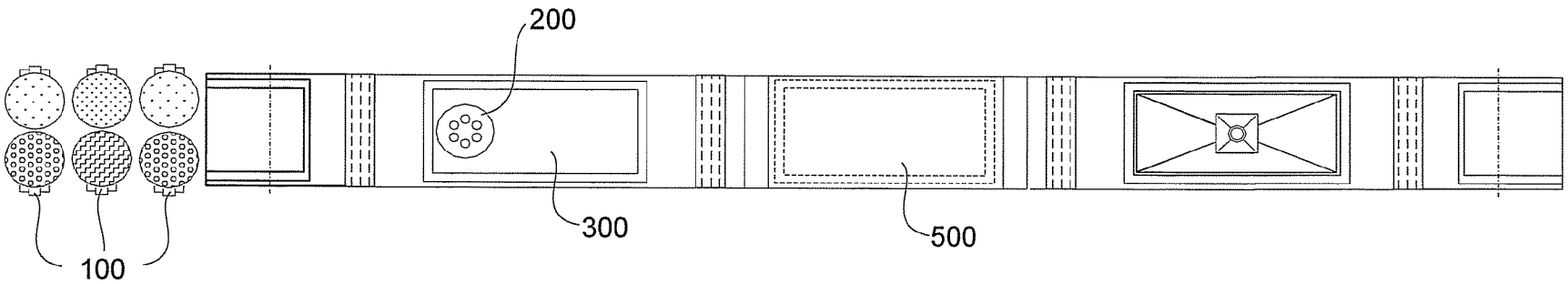
FIG. 2 shows top view one exemplary embodiment of an apparatus for forming ceramic tiles according to principles described herein.

FIG. 1 and FIG. 2 show one exemplary embodiment of the apparatus for forming desired patterns on ceramic tile with a prescribed thickness. The apparatus comprises slurry holding tanks (100); a pattern forming unit (200) connected to the slurry holding tanks (100) by delivering tubes (105); a pattern forming tray (300); various pattern decorating accessories (400); and a filter press unit (500).

The components of the apparatus operate in a sequential fashion as shown in FIG. 1 and FIG. 2. Slurry holding tanks (100) convey slurry through the delivering tubes (105) to the pattern forming unit (200). The pattern forming unit (200) dispenses a predetermined type and amount a slurry with specific characteristics, such as particle size, texture, composition and color. The slurry is deposited in a predetermined order into the pattern forming tray (300) to form a desired pattern. The slurry within the pattern forming tray (300) is then pressed with the filter pressing unit (500) to form ceramic tiles or slabs with a desired pattern running though its entire thickness. Each component of the apparatus will now be described in detail.

Slurry Holding Tank

The slurry holding tank (100) is configured to holding soil slurry to be used to produce the tiles. There could be more than one holding tank (100) to contain different types and colors of the slurry. The holding tank (100) has a means to reduce precipitation of the slurry so as to promote flow or plasticity of the slurry to the patterning forming unit (200). For example, the inside of the tank may be equipped with at least one agitator (110) to encourage movement of the slurry, or the holding tank (100) may sit on a movable base (not shown) so that movement of the holding tank (100) causes the content inside to move continuously. In addition, to improve flow of the slurry, the holding tank (100), if required, may be equipped with heating unit (not shown) with a means to control the temperature of the slurry to a desired range so as to reduce viscosity of the slurry. The pressure inside the holding tank (100) may also be controlled to further facilitate the function of the holding tank. The holding tank (100) is connected to delivering tubes (105) to deliver the slurry to a pattern forming unit (200).

Pattern Forming Unit

Figure 3C:
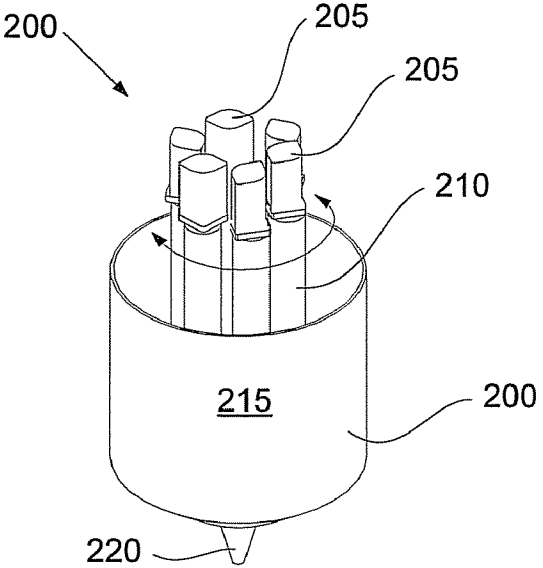
FIGS. 3A, 3B, and 3C show a top view, a side view, and a perspective view, respectively, a pattern forming unit configured to distribute the slurry into a pattern forming tray, according to principles described herein.
Figure 3B:
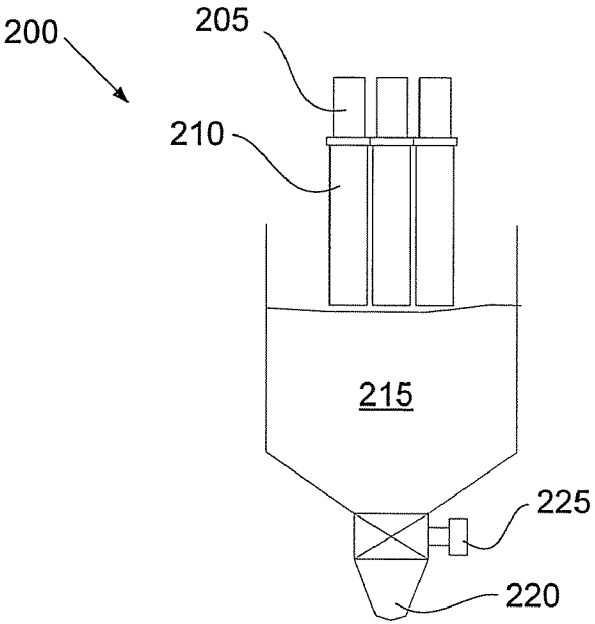
Figure 3A:
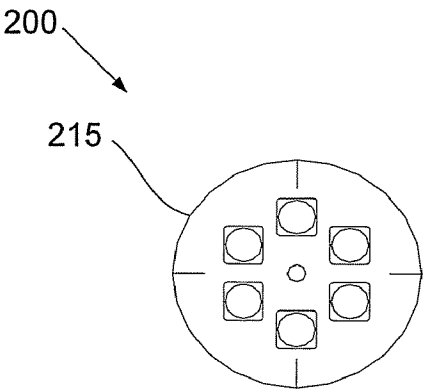
Figure 4:
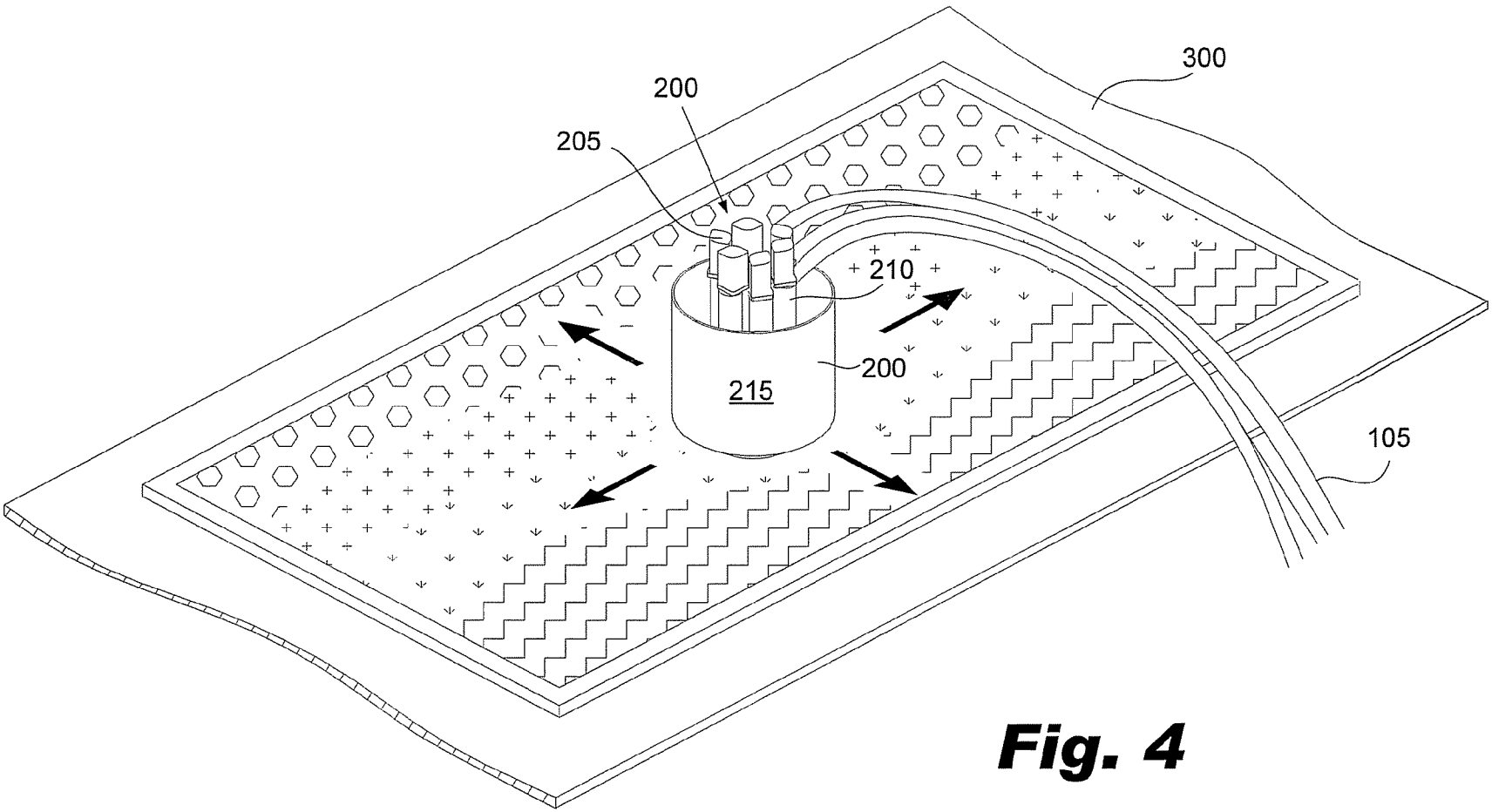
FIG. 4 shows an embodiment of the pattern forming set of the apparatus according to FIG. 1 distributing the slurry into a pattern forming tray, according to principles described herein.

As shown in FIG. 3 and FIG. 4, the pattern forming unit (200) is connected to the slurry holding tank (100, FIG. 1) by delivering tubes (105, FIG. 1). The pattern forming unit (200) can be coupled to more than one delivering tube (105, FIG. 1). The slurry is delivered through the delivering tube or tubes (105, FIG. 1) under controlled pressure and/or controlled temperature). Each delivering tube (105, FIG. 1) at the pattern forming unit (200) is fitted with a valve (205) in order to regulate the amount of slurry dispensed from the attached delivery tube (105, FIG. 1) into the pattern forming unit (200). The valve (205) is fitted with a removable end piece (210). A variety of removable end pieces (210) with varying configurations and exit geometries could be attached to the valve. Different configurations of the end piece (210) and its end allow flexibility in generating various patterns or to produce predetermined patterns.

The pattern forming unit (200) has a slurry holding portion (215) capable of holding the slurry dispensed from the delivering tubes (105). Different types and colors of the slurry are allowed to mix in this portion so as to create different lines and streaks. The end of the pattern forming unit (200) is fitted with a removable dispensing member (220). The opening end of the dispensing member (220) can be of any desired known configuration to create further variation of the lines and streaks once the slurry is dispensed into the pattern forming tray (300, FIG. 1). In another embodiment, the dispensing member (220) maybe equipped with a valve (225) to regulate the amount and speed of the slurry being dispensed as shown in FIG. 3B. In a further embodiment (not shown), the pattern forming unit (200) is fitted with more than one dispensing member (220). The dispensing member (220) is capable of rotating in a circular motion in accordance with the predetermined position and the colors of the slurry to be deposited into the pattern forming tray (300, FIG. 1). As shown in FIG. 4, the entire pattern forming unit (200) is also capable of moving in all directions, such as left, right, backward, and forward or in a circular motion relative to the shape and size of the pattern forming tray (300, FIG. 1). There could be more than one pattern forming unit (200) dispensing the slurry into the same pattern forming tray (300, FIG. 1) so as to deposit the slurry of desired type and colors combinations at specific locations to create a desired or predetermined pattern.

The dynamics of the delivery of the slurry to the pattern forming unit can be sensed and controlled electronically. By way of example, the movement of the pattern forming unit (200), the speed of the movement of the pattern forming unit (200) as a whole, the movement of the dispensing member (220), and the degree of opening of the valves (205) fitted at the delivering tubes and/or at the valve (225) end of the dispensing member (220) can be regulated by a software application developed for this purposes wherein a desired pattern is pre-coded in the application.

Figure 5:
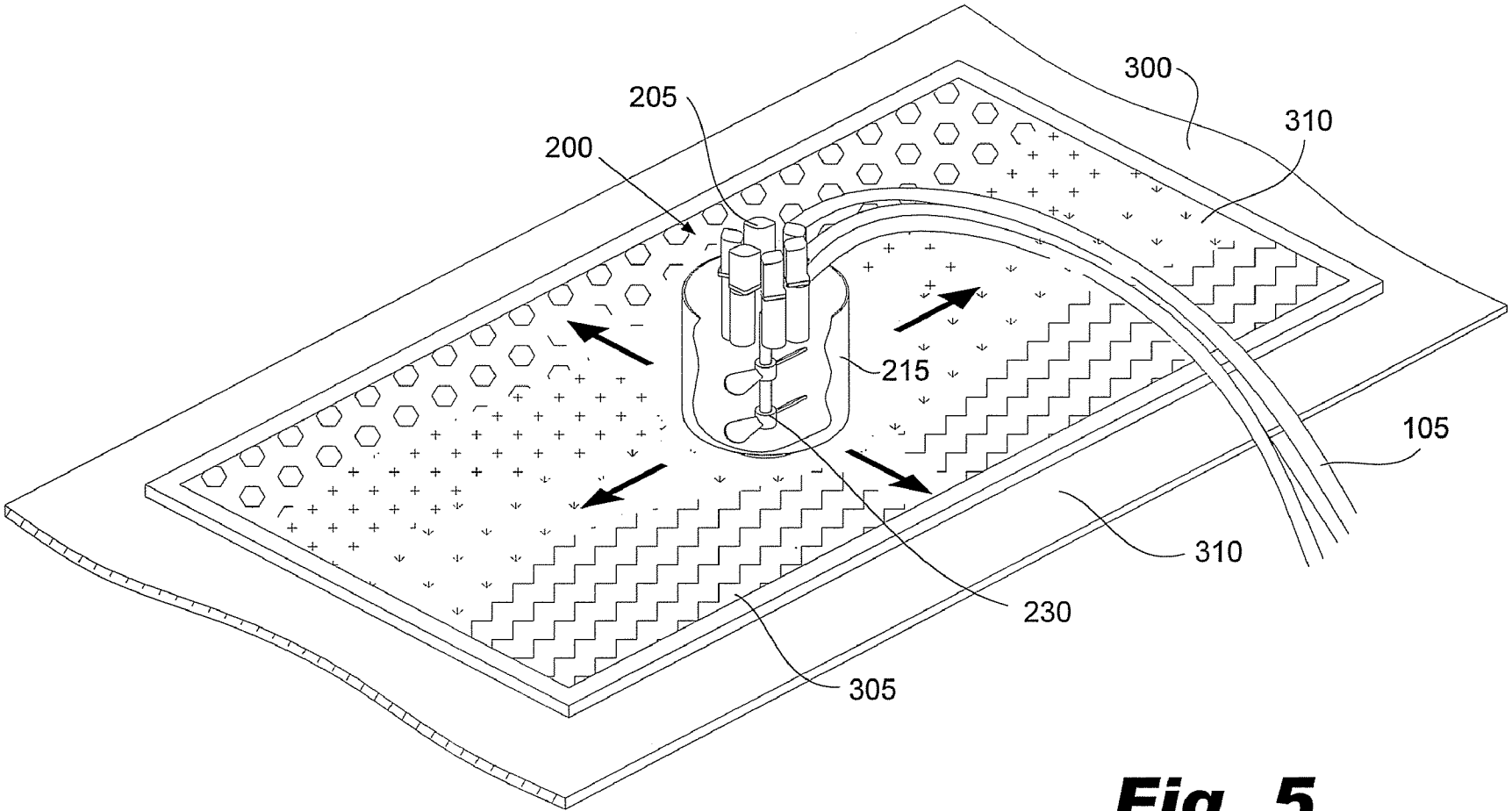
FIG. 5 shows a further embodiment of the pattern forming set according to FIG. 2 wherein the pattern forming set is equipped with agitating means, according to principles described herein.

In another embodiment of the pattern forming unit (200), as shown in FIG. 5, the pattern forming unit (200) is fitted with a means to promote or maintain flow of the slurry. The means to promote or maintain the flow of the slurry could comprise at least one agitator (230) situated inside the slurry holding portion (215). The agitator (230) not only promotes and maintains the flow of the slurry, but also helps with the mixing and blending of the slurry. The geometric configuration and motion of the agitator (230) also helps to create patterns with different characteristics. Specifically, the size and speed of the agitator (230) will affect the size of the lines and streaks of the slurry being dispensed therefrom.

Figure 6:
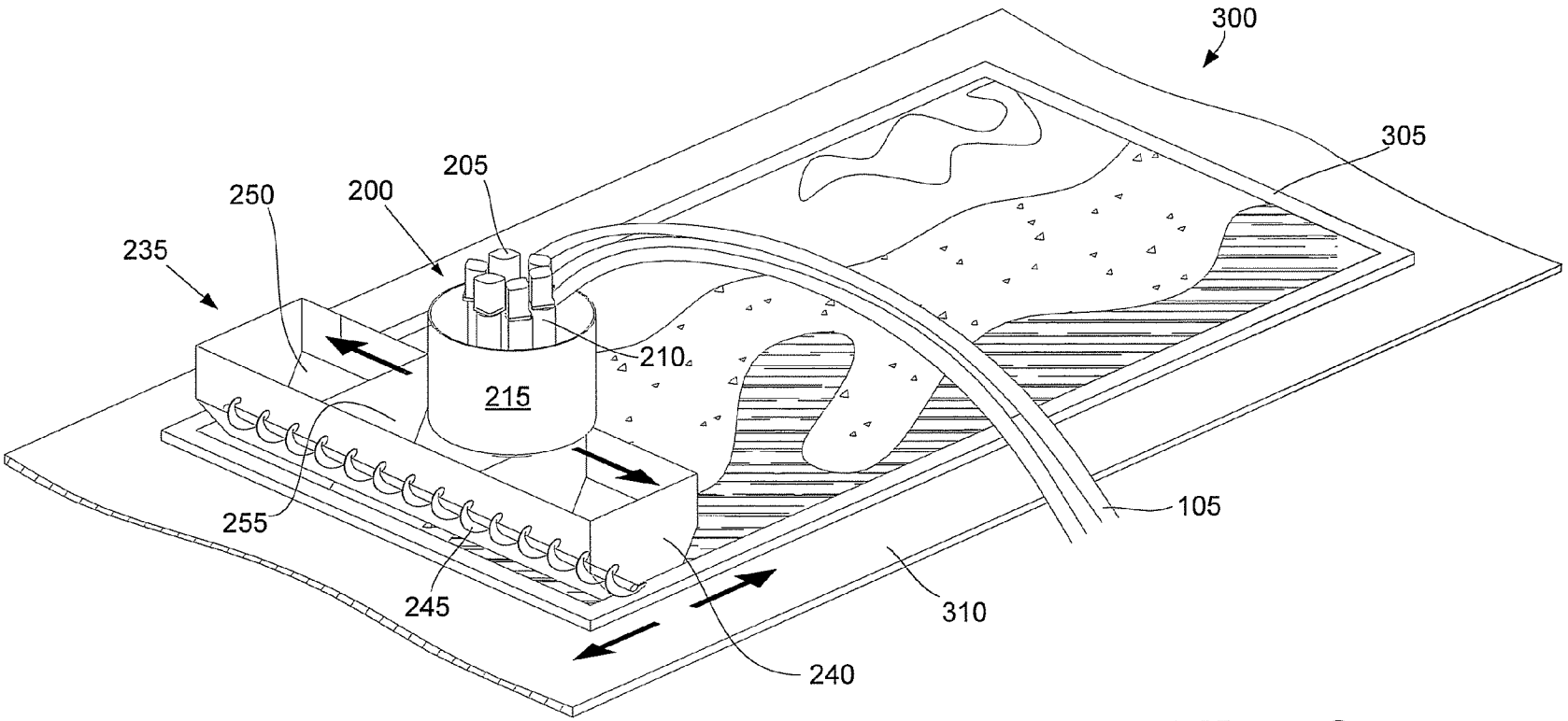
FIG. 6 shows further embodiment of the pattern forming set according to FIG. 2 or FIG. 3 wherein the pattern forming set is further equipped with pattern receiving tray, according to principles described herein.

FIG. 6 shows further embodiment of the pattern forming unit (200). In this embodiment, the pattern forming unit (200) is further equipped with a pattern receiving tray (235). This particular embodiment is suitable for producing a ceramic tile or slab with assorted colors or patterns or a tile or slab with different color tones. In this embodiment, the slurry is dispensed from the dispensing member (220) into a pattern receiving tray (235) and is subsequently dispensed into the pattern forming tray (300) instead of being dispensed directly into the pattern forming tray (300) from the pattern forming unit (200). When the slurry is dispensed into the pattern forming tray (300), the desired pattern is formed.

The pattern receiving tray (235) is movable across the pattern forming tray (300) and comprises a body (240) for containing the slurry, a means for mixing the slurry and driving the slurry toward the opening located at the bottom region of the pattern receiving tray (235), wherein the means for mixing and driving, in one exemplary embodiment is a spiral screw (245) positioned across the opening in the bottom region. The bottom of the pattern receiving tray (235) is fitted with an open-close member (260, FIG. 7) through which the slurry is dispensed into the pattern forming tray (300). In one exemplary embodiment, the size of the pattern receiving tray (235) should correspond with the size of the pattern forming tray (300). Additionally, the length of the body (240) should be around the same size as the width of the pattern forming tray (300) if the slurry is to be distributed into the pattern forming tray (300) lengthwise.

The body (240) of the pattern receiving tray (235) may be divided into smaller compartments (250) using zoning boards (255) wherein each compartment (250) can hold the slurry with different colors or different combination of colors or combination of colors with various tones or different based patterns formed within the slurry holding portion (215). The zoning boards (255) are removably fixed to the body (240) so that the size of the compartment (250) may be adjusted by adding or removing one or more of the zoning boards (255) or by moving one or more of the zoning boards (255) along the body (240). Dividing the body (240) of the pattern receiving tray (235) into zones will improve the definition of the pattern because it reduces the degree that slurries with different colors and/or patterns mix with one another.

The spiral screw (245) which is located in the bottom region of the patter receiving tray (235) is set along the length of the body (240) of the pattern receiving tray (235). The spiral screw (245) is capable of turning about its longitudinal axis. The number, size, and distance of the spiral configuration may be varied to create patterns with different sizes of color bands, streaks, lines or other variations of the pattern. The movement of the spiral screw (245) may be controlled by suitable electronic devices or pre-coded in the software application. The movement of the spiral screw (245) drives the slurry toward the opening at the bottom of the pattern receiving tray (235) for which the slurry is distributed into the pattern forming tray (300). The speed of the movement of the spiral screw (245) contributes to variation of the pattern being formed as well.

The pattern forming unit (200) can be configured to dispense slurry into the pattern forming tray (300) with or without the pattern receiving tray (235). Regardless of the configuration, the delivery of the slurry can result in the desired distribution of slurry across the pattern forming tray (300). For the embodiment with the pattern receiving tray (235), while the slurry is being dispensed the spiral screw (245) will turn continuously, driving the slurry through the opening of the open-close member (260, FIG. 7) located at the bottom of the pattern receiving tray (235) which will be in its open state when the slurry is being dispensed. The amount of total weight of the slurry being dispensed is controlled by a weight sensor with the scale (not shown) underneath the pattern forming tray. That is, the pattern forming tray is positioned on a weighing device while the slurry is being distributed. The weighing device is linked to the software application. Once the amount of the slurry reaches the predetermined weight, the weighing device will activate and the dispensing unit (200) will temporarily withhold dispensing and the open-close member (260) will move to a closed state and the pattern forming unit (200) will resume its starting location. The pattern forming unit (200) will resume dispensing when the next empty pattern forming tray (300) moves into position under the pattern forming unit (200). In addition, the amount of the slurry being dispensed from the dispensing member (220) into the pattern receiving tray (235) should correspond with the amount of the slurry being dispensed from the pattern receiving tray (235) to the pattern forming tray (300) so as to reduce the likelihood of overflow or shortage of the slurry.

Figure 7B:
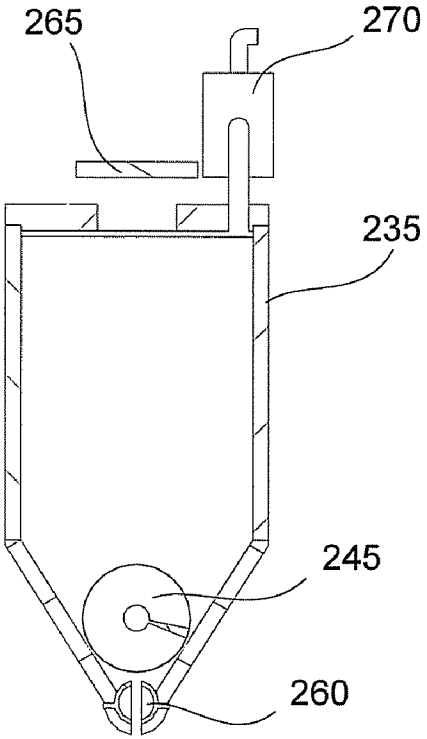
FIG. 7A-7B shows further embodiment of the pattern receiving tray, according to principles described herein.
Figure 7A:
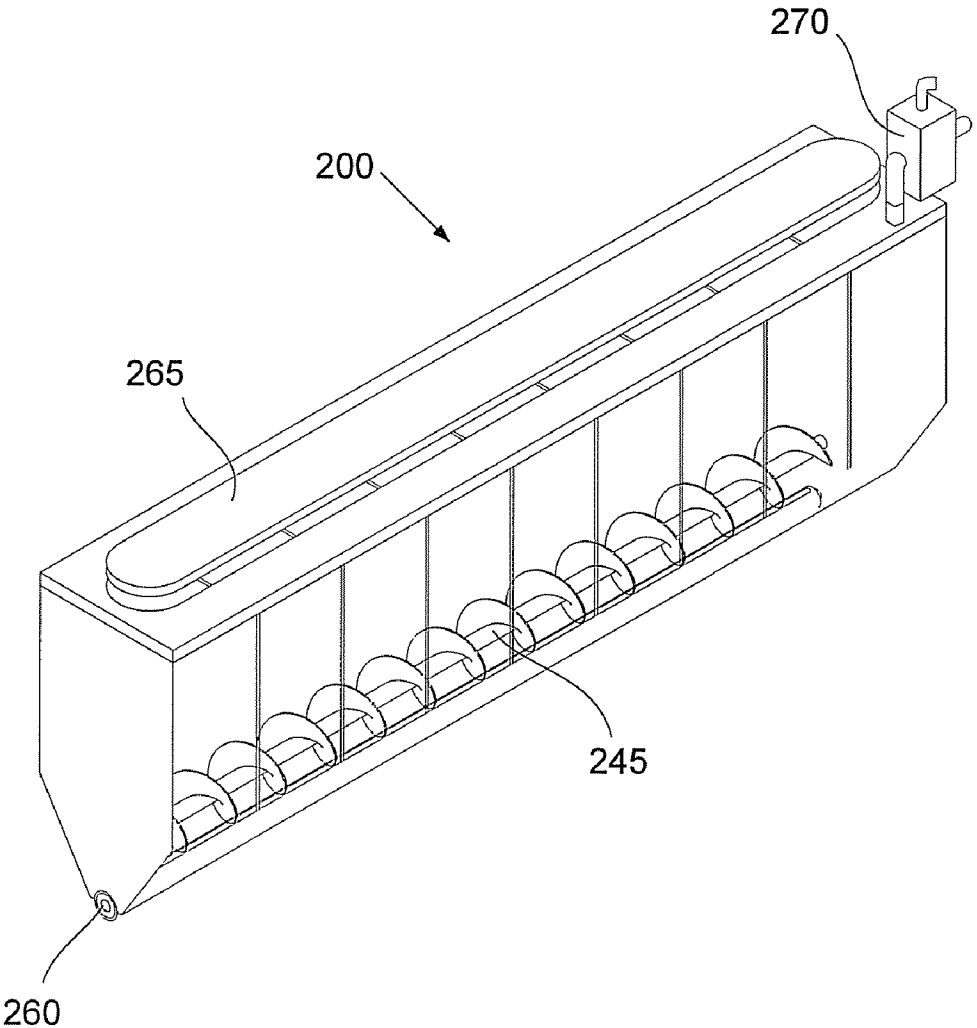

FIG. 7 shows a further embodiment of the pattern receiving tray (235). This embodiment of the pattern receiving tray (235) is larger in size and capable of holding a larger quantity of the slurry for producing larger ceramic tiles or slabs. In this embodiment, the large quantity of the slurry creates higher pressure inside the tray making it difficult to control the flow of the slurry. Therefore, in this embodiment, the pattern receiving tray (235) is further provided with an open-closed lid (265) and a high definition pneumatics system (270). After the desired quantity of the slurry is transferred into the pattern receiving tray (235), the open-close lid (265) is then closed, and the air inside the tray is removed to create a vacuum environment. The slurry is then dispensed by controlling the pneumatic system in combination with controlling the open-close member (260) at the bottom of the pattern receiving tray (235) to open and close as needed. In one exemplary embodiment, the variable opening of the open-close member (260), the speed of the spiral screw (245), and/or the pressure inside the pattern receiving tray (235) are regulated and maintained by the software application to achieve the desired pattern.

Pattern Forming Tray

Figure 8:
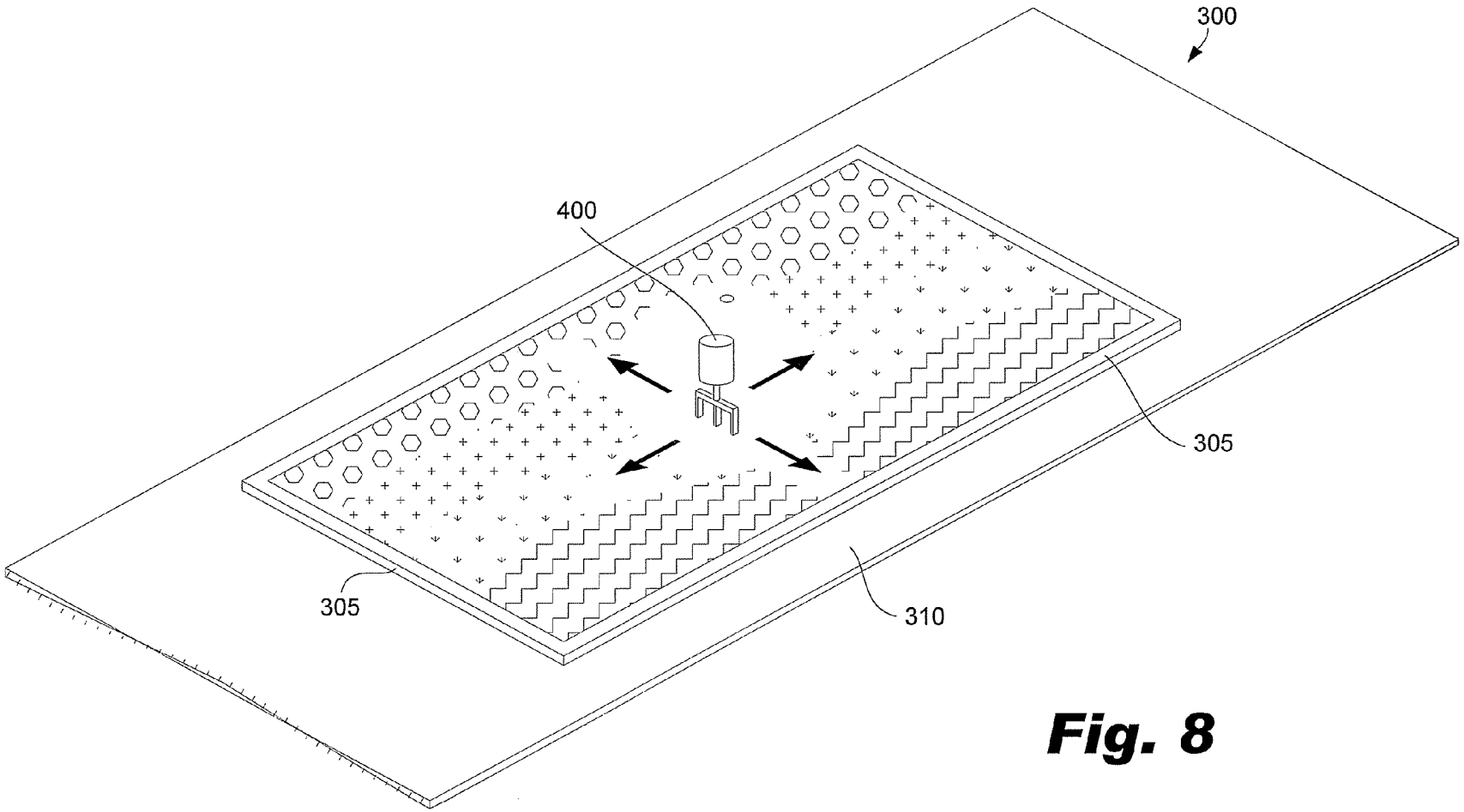
FIG. 8 shows and embodiment of the pattern forming accessories, according to principles described herein.
Figure 9:
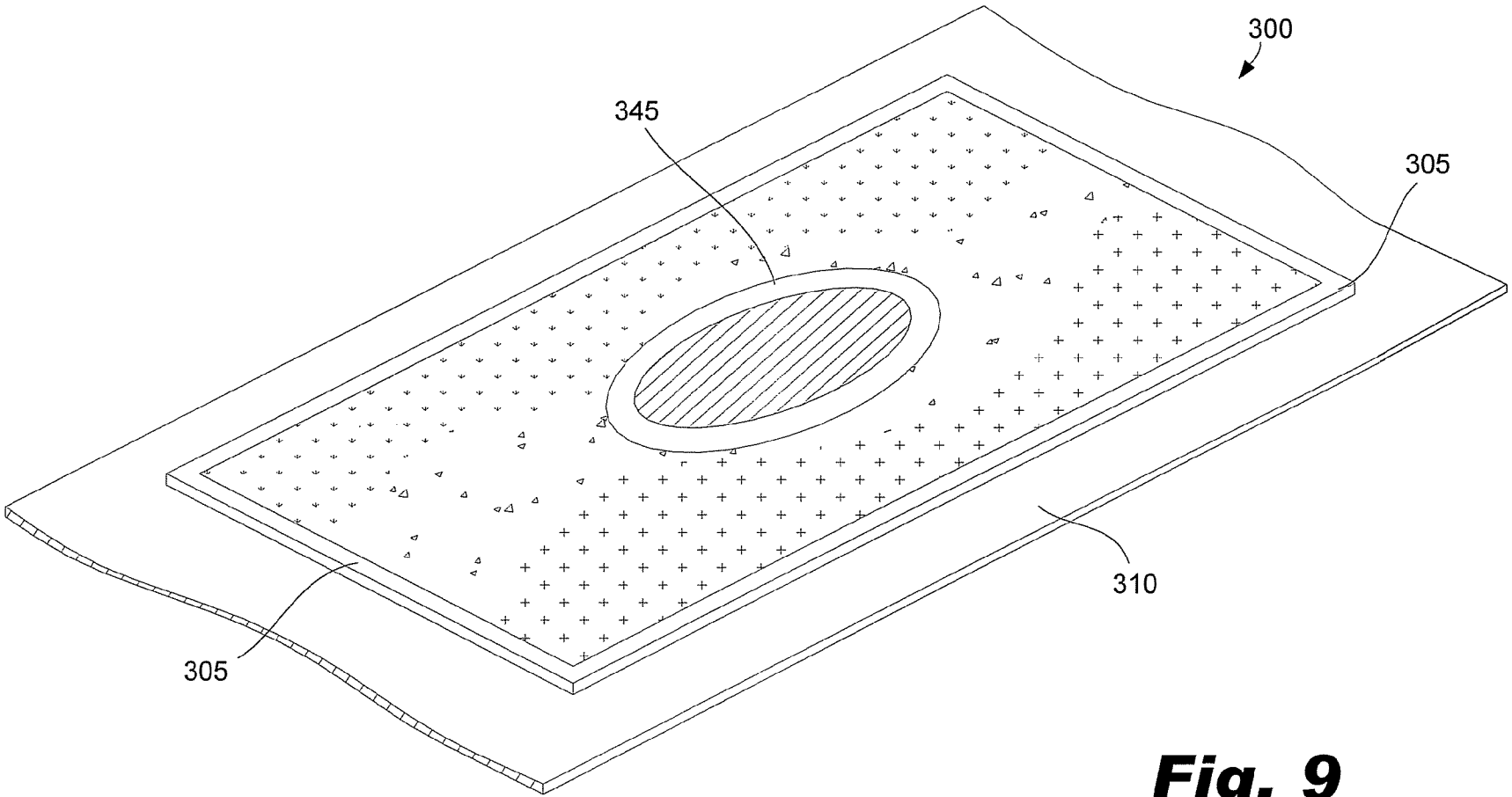
FIG. 9 shows an embodiment of the pattern forming tray, according to principles described herein.
Figure 10:
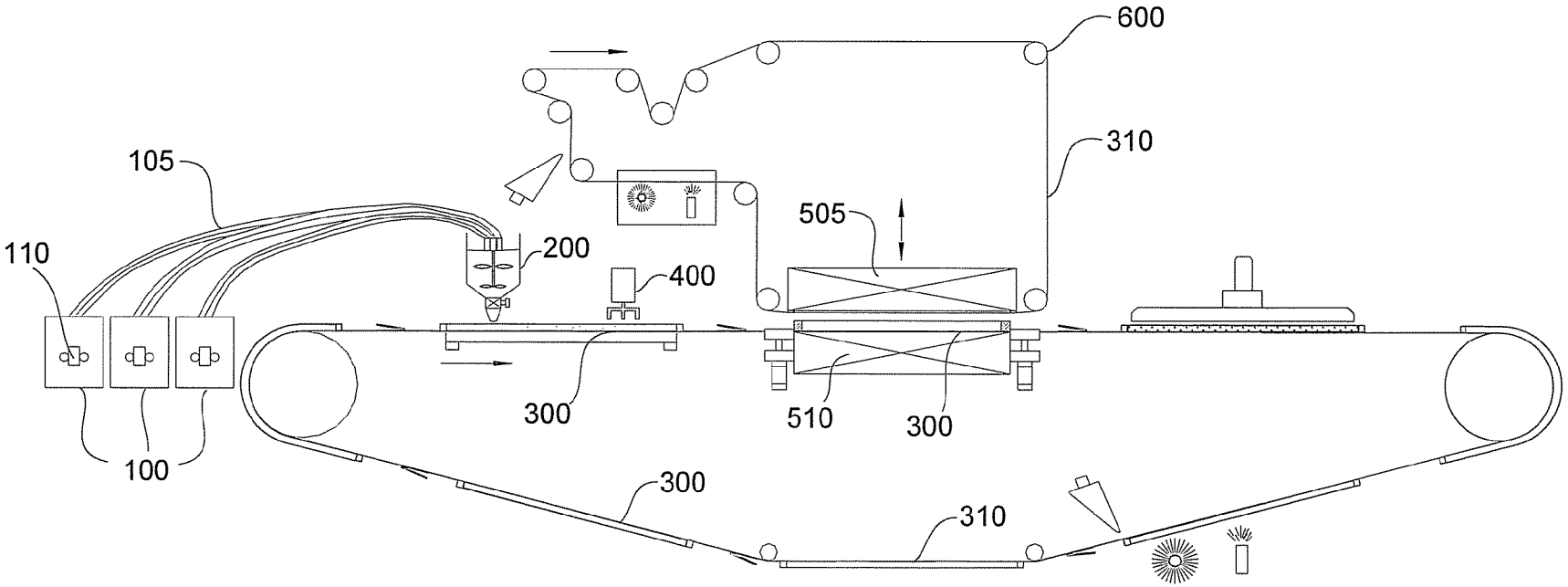
FIG. 10 shows side view of the embodiment of the apparatus according to FIG. 1 employing the pattern forming set according to FIG. 5, according to principles described herein.
Figure 11:
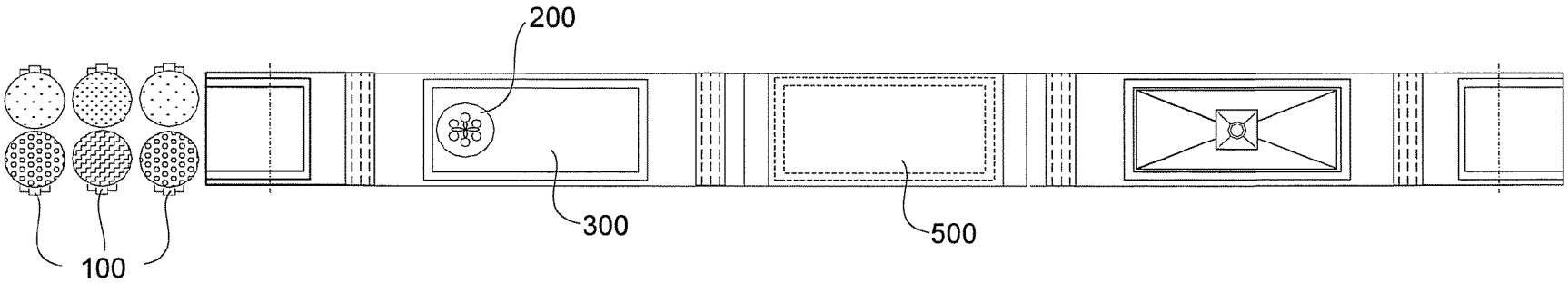
FIG. 11 shows top view of the embodiment of the apparatus according to FIG. 1 employing the pattern forming set according to FIG. 5, according to principles described herein.
Figure 12:
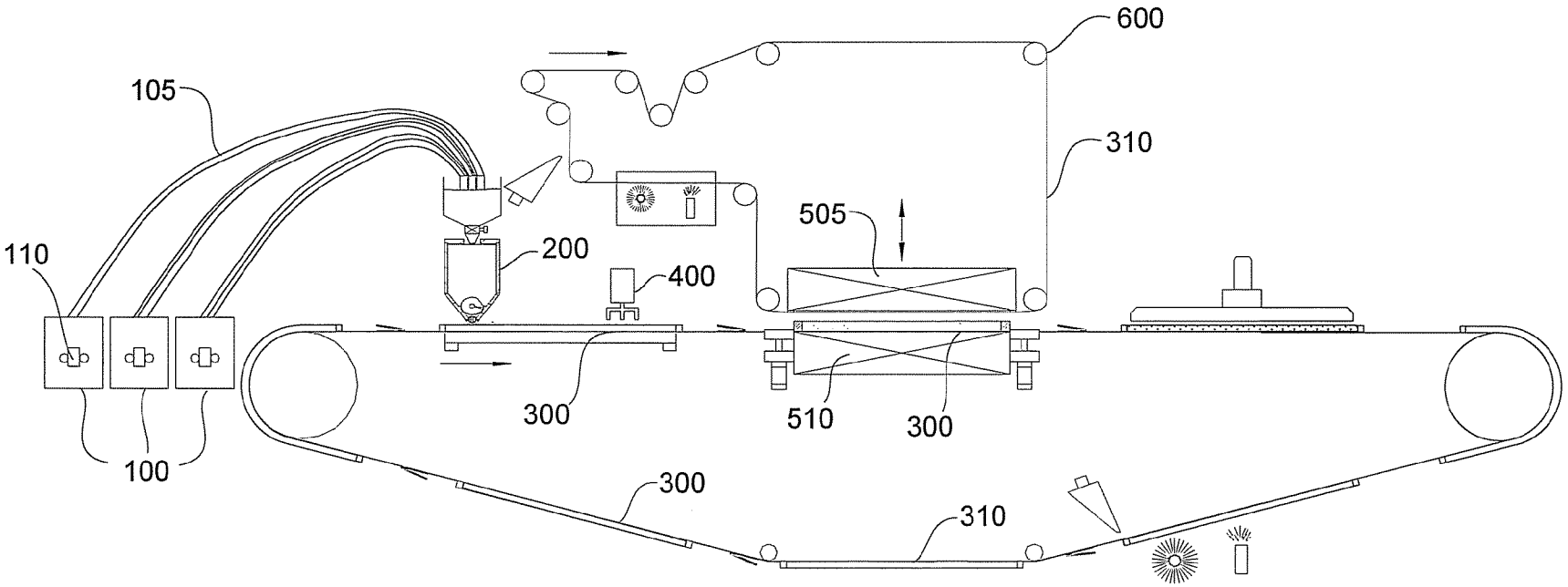
FIG. 12 shows side view of the embodiment of the apparatus according to FIG. 1 employing the embodiment of the pattern receiving tray according to FIG. 6, according to principles described herein.
Figure 13:
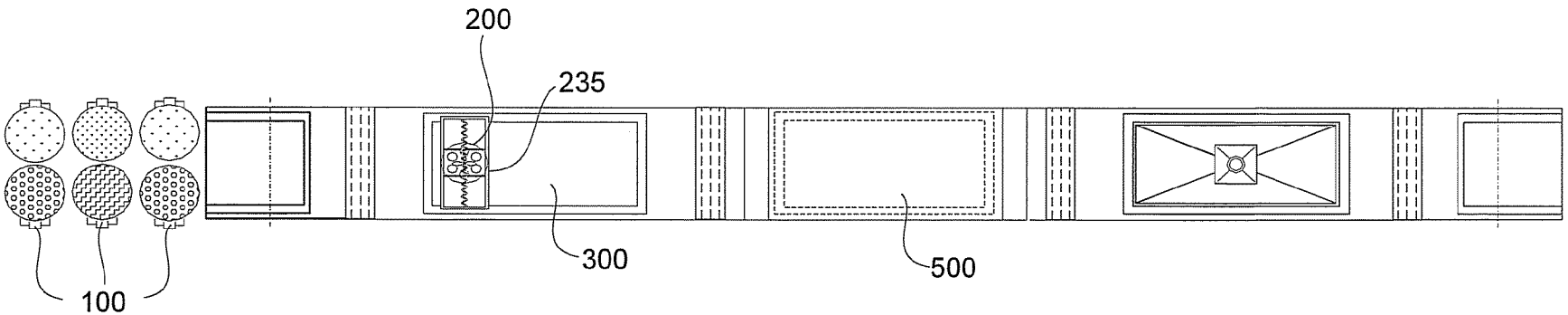
FIG. 13 shows side view of the embodiment of the apparatus according to FIG. 1 employing the embodiment of the pattern receiving tray according to FIG. 6, according to principles described herein.
Figure 14:
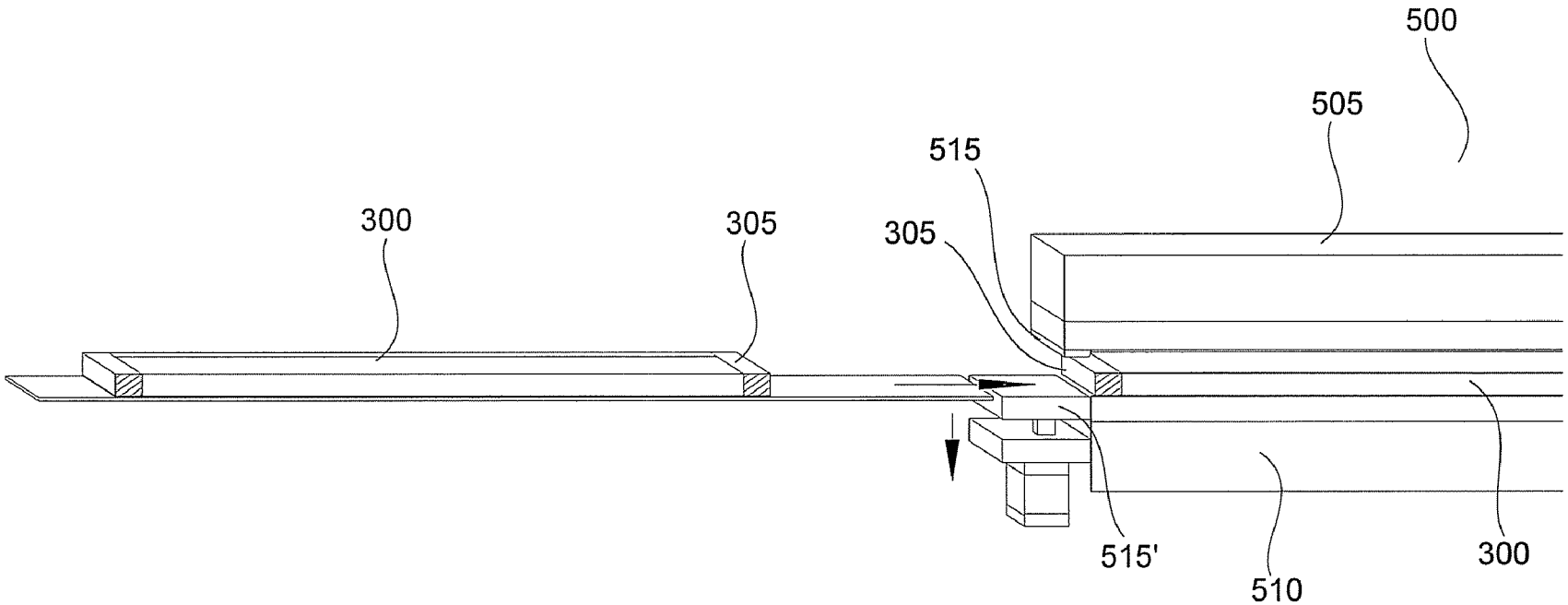
FIG. 14 shows the pattern forming tray moving toward the filtered pressing unit, according to principles described herein.

The pattern forming tray (300) acts as a mold for the tiles or slabs, with the size and shape of the pattern forming tray corresponding to the shape and size of the desired tile or slab. The pattern forming tray (300) comprises a frame (305) and an underlying filter sheet (310). The frame (305) forms the border of the pattern forming tray (300) and the underlying filter sheet (310) forms the bottom of the pattern forming tray (300). As shown in FIG. 8, a rectangular pattern forming tray (300) having an outer closed frame border can be used to produce a rectangular tile or slab. In this embodiment, the pattern forming tray (300) comprises only an outer closed frame border. FIG. 9 shows further embodiment of the pattern forming tray (300) configured to produce a tile or slab with an interior aperture. To form the interior aperture the forming tray comprises also at least one interior border (345) at designated position which defines an empty space inside the tray. This embodiment of the pattern forming tray (300) is suitable for producing ready-to-use items, such as, a sink counter or kitchen counter top, without having to make any modifications to the slab. Of course, the additional empty space defined by the interior border (345) includes but is not limited to square, rectangular, circular, oval, and other desired free forms to suit the utilization of the tile or slab.

As mentioned, the pattern forming tray (300) comprises a frame (305) and a filter sheet (310) assembled on top of one another.

The frame (305) may be of any desired shapes assembled on top of the filter sheet. The frame (305) is made from a flexible material which can withstand high pressure and return to its original shape after the pressure is removed. The frame (305) may be made from the material or combination of materials selected from natural rubber, natural polymer, synthetic rubber, thermoplastic elastomer, silicone rubber, butadiene rubber, ebonite rubber, elevated temperature vulcanized rubber, urethane rubber, fluorine rubber, neoprene rubber and the like or metal specifically designed to flex under high pressure. In one exemplary embodiment the height of the frame (305) determines the maximum quantity of the slurry that can be held. Thus, the height of the frame (305) can determine the height of the desired tile or slab.

The filter sheet (310) forming the bottom of the pattern forming tray (300) is a porous sheet capable of containing the slurry under normal conditions, but which allows water and particles smaller than the size of the pores of the filter sheet (310) to pass through when pressure or weight is applied. It is important that the filter sheet (310) should have suitably sized pores to prevent too many particles from passing through, resulting in the waste of the slurry. The materials for making the filter sheet (310) may be selected from wool fiber, nylon, metal wire mesh, polypropylene, polyester, polybuthylene, and polyamide.

Preferably, the pattern forming trays (300) should be connected to one another forming into a conveyer to support automatic or semiautomatic production. However, each pattern forming tray (300) should preferably be detachable and replaceable when replacement or maintenance is needed.

The Pattern Decoration Accessory

After the predetermined quantity of the slurry has been distributed into the pattern forming tray (300), the integration or aggregation of the different types, colors, lines or streaks of the slurry will forms into the pattern of the tile or slab. However, to achieve the desired pattern or to create further variation on the already formed pattern, the pattern decoration accessory (400) may be used to achieve the desired pattern effects, as shown in FIG. 8. The pattern decorating accessories (400) may operate synchronously with the pattern forming unit (200) or after the pattern forming unit (200) has completed its cycle of pattern formation. The pattern decorating accessory (400) can be of various forms and shapes and configurations as long as it can perform by dragging, dipping, stirring, mixing or sweeping across or into the formed pattern. FIG. 8 shows an example of the embodiment of the pattern decorating accessory (400). In this embodiment, the pattern decorating accessory (400) has a plurality of tooth—like extensions from a body. The body is connected to an electronic device (not shown) which is capable of controlling the movement of the pattern decorating accessory (400). The teeth may be connected to the body by simple locking or coupling elements or can be snapped onto a joint. The quick removal and replacement of the teeth or other accessories facilitates reconfiguring the pattern decorating accessory (400). The movement of the pattern decorating accessory (400) may be controlled by being pre-coded in the software application as with the pattern forming unit (200) so as to achieve a predetermined pattern.

Filter Pressing Unit

After pattern formation by the pattern forming unit (200) and/or the pattern decorating accessory (400) is completed, the formed pattern inside the pattern forming tray (300) is ready for pressing. The pattern forming tray (300) moves toward the filter pressing unit (500) as shown in FIG. 1.

Figure 15:
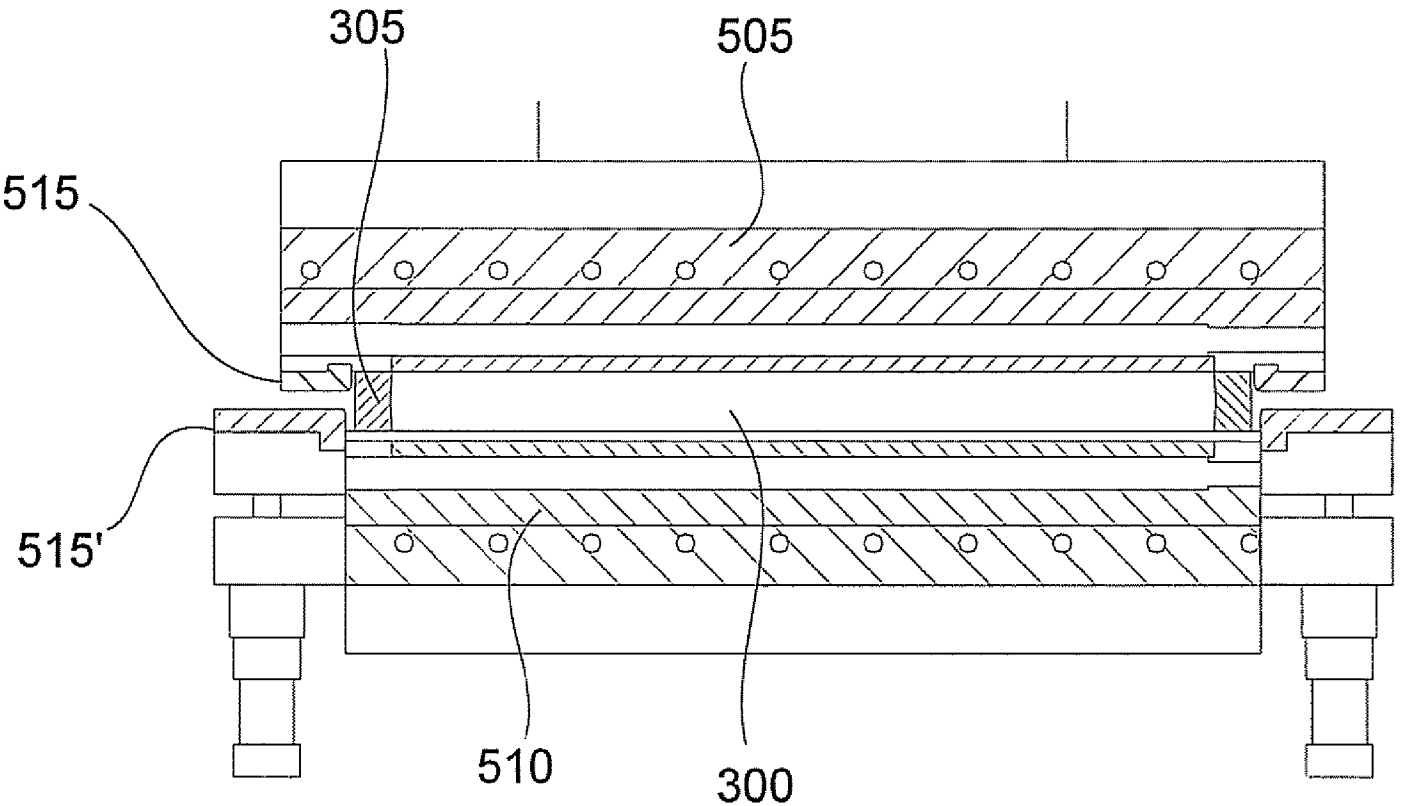
FIG. 15 shows the filter pressing unit, according to principles described herein.
Figure 16:
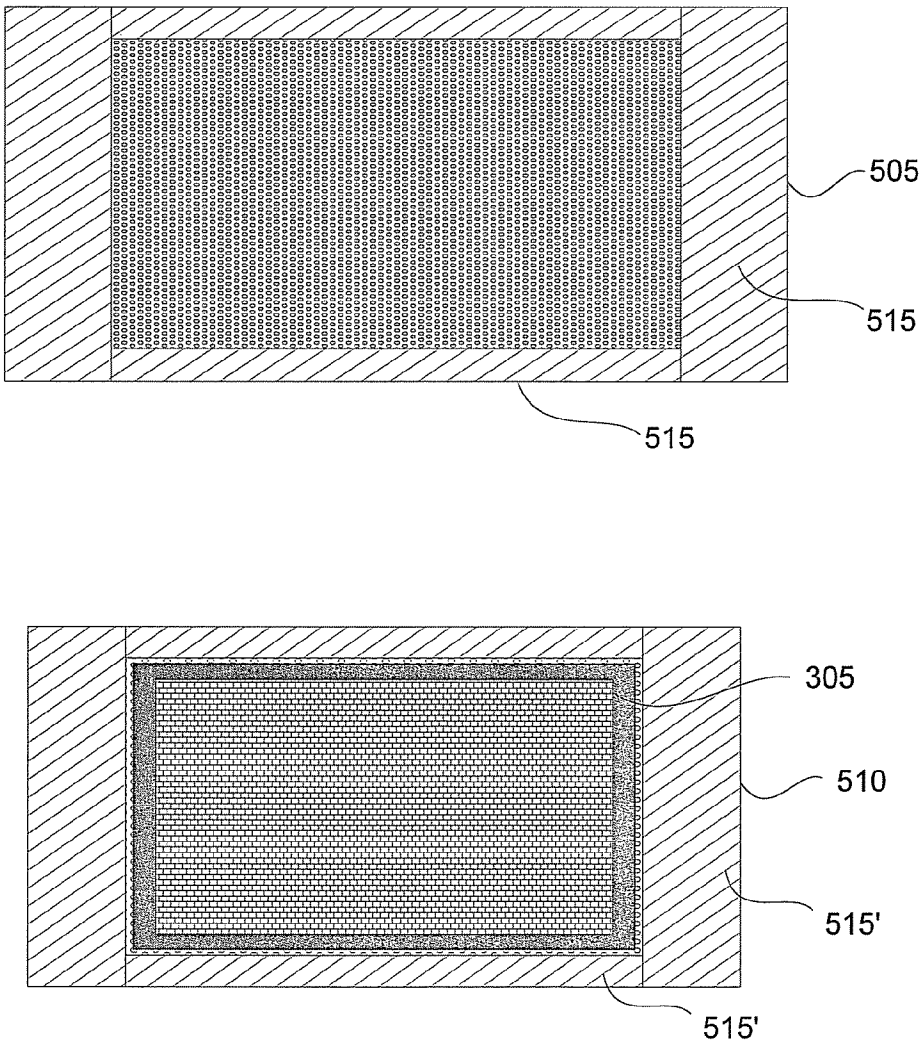
FIG. 16 shows the upper punch and lower punch of the filter pressing unit, according to principles described herein.
Figure 17:
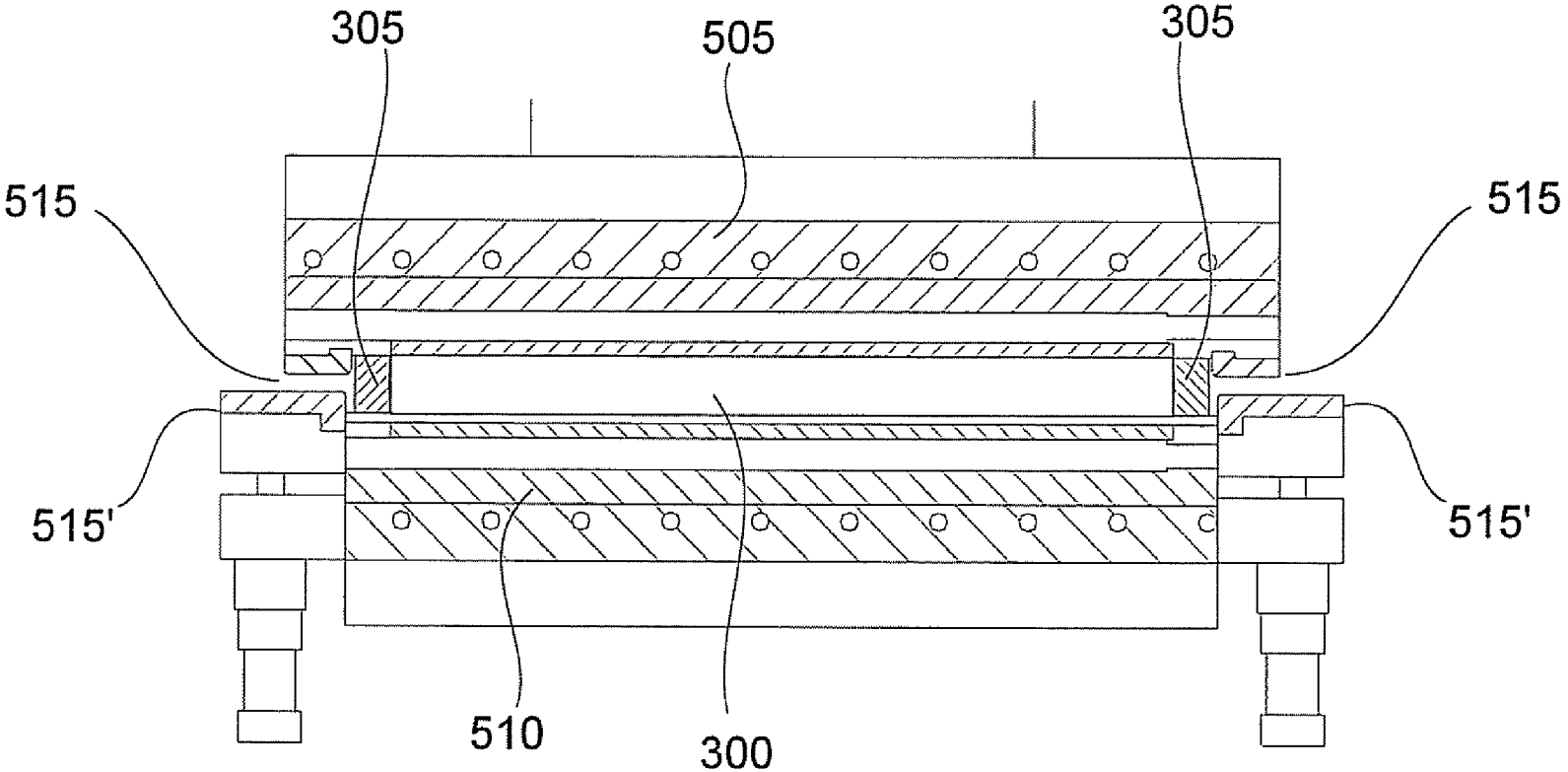
FIG. 17 shows the filter pressing unit in one operative position, according to principles described herein.
Figure 18:
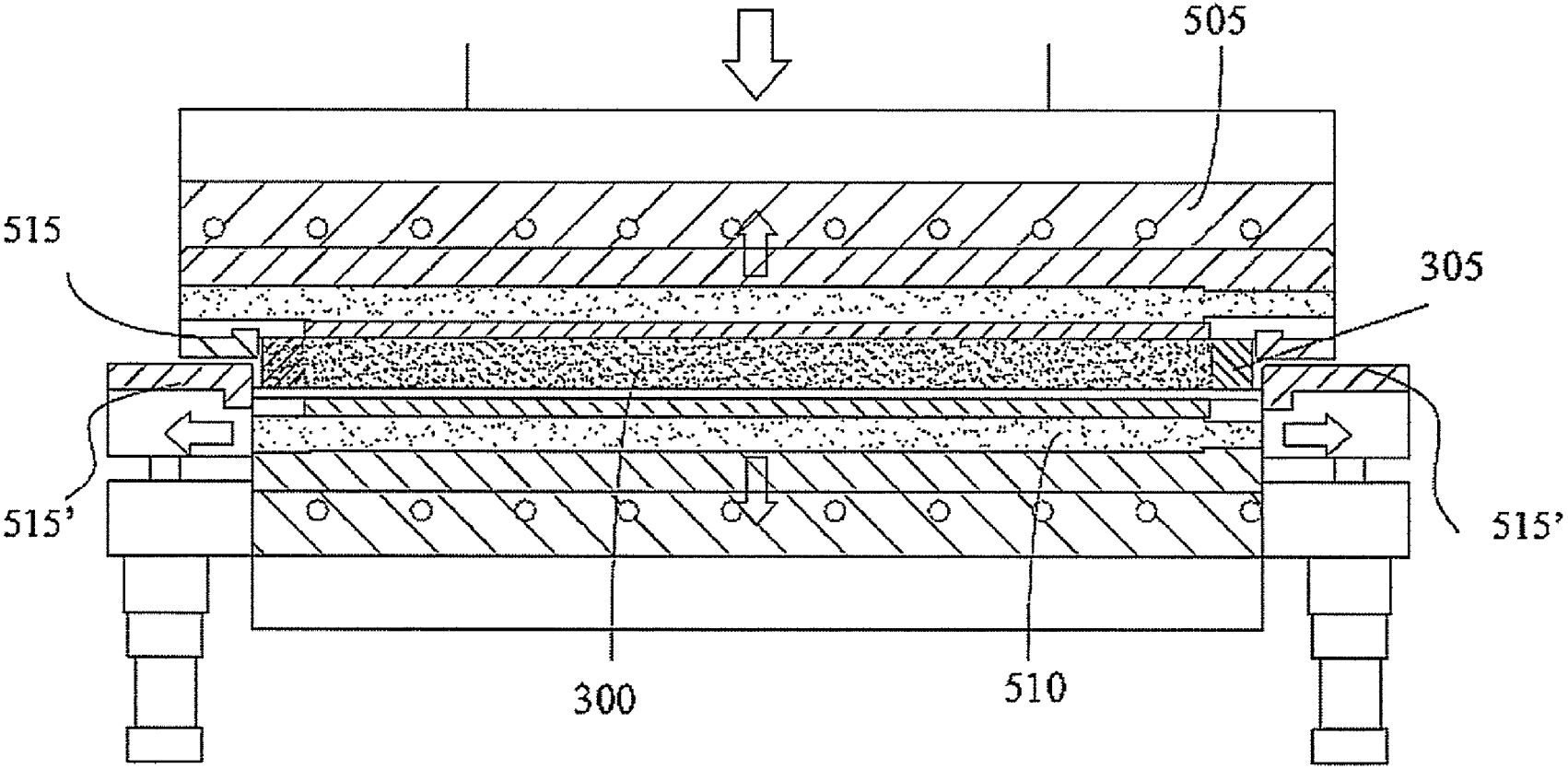
FIG. 18 shows the filter pressing unit in a different operative position, according to principles described herein.

The filter pressing unit (500), as shown in FIG. 15 and FIG. 16, operates under the same principles as with a general hydraulic pressing machine, by applying pressure onto the object. The filter pressing unit according to this invention is a wet pressing unit. The objective is to remove as much excess water from the slurry as possible, leaving a green ceramic tile or slab with the water content commonly known in the ceramic tile industry to be suitable for drying.

Consequently, filtration is an integral element of the filter pressing unit (500). The filter pressing unit (500) comprises an upper punch (505), a lower punch (510), shape retaining frame (515), a vacuum pump (not shown), and may be further fitted with additional components such as a heater, temperature control unit, and/or a fan.

The upper punch (505) is made of metal, high strength ceramic or composite materials. In one exemplary embodiment, the surface upper punch is a flat porous face with small holes or pores distributed throughout the face. The face is fitted with a shape retaining frame (515). The shape of the shape retaining frame (515) must correspond to the shape of the pattern forming tray (300). For example, as shown in FIG. 15 and FIG. 16, the shape retaining frame (515) is rectangular to correspond with the rectangular pattern forming tray (300). The upper punch (505) is prepared with a drain (not shown). The upper punch (505) operates under hydraulics and is capable of moving toward a fixed lower punch (510) so as to press the slurry contained in the pattern forming tray (300) positioned between them. Once the slurry is pressed, the excess water and slurry particles smaller than the pore size of the filter sheet (310) will escape through the pores of the filter sheet (310) and through the holes prepared on the face of the upper punch (505) and will be collected in the drain for disposal.

Similarly, the lower punch (510) is made of metal with a flat face. The surface of the flat face is also porous with small holes or pores distributed throughout the face. The face is fitted with a shape retaining frame (515'). The shape of the shape retaining frame (515') must correspond to the shape of the pattern forming tray (300). The lower punch (510) is fixed to a position and is also provided with a drain.

The shape retaining frame (515) on the upper punch can be configured such that it is substantially above and aligned with the retaining frame (515') on the lower punch. During pressing the face of the shape retaining frame on the upper punch (505) meets or almost meets with the face of the shape retaining frame (515') on the lower punch (510) when maximum pressure is applied enclosing the pattern forming tray (300).

As mentioned, the shape of the shape retaining frames (515-515') must correspond to the shape of the pattern forming tray (300). However, the size of the shape retaining frames (515-515') should be slightly larger than the pattern forming tray (300) because, during the pressing, the pattern forming tray (300) is positioned inside the shape retaining frames (515-515'). During pressing, the frame of the pattern forming tray (300) which is made from flexible materials will distort under pressure which could cause distortion of the shape or the pattern of the tile or slab. Therefore, the shape retaining frames (515-515') will reduce this problem.

In addition, to allow the pattern forming tray (300) to move forward and into the position to be pressed and move forward after pressing is completed, the shape retaining frames (515-515') on the incoming direction and out-going direction should be able to move up and down or forward or backward such that it is level with the surface of the lower punch (510). For example, as the pattern forming tray (300) moves toward the filter pressing unit (500), the shape retaining frames (515-515') on the incoming direction will retract, allowing the pattern forming tray (300) to move into position. Once the pattern forming tray (300) meets the outgoing side (opposite the incoming side) of the shape retaining frames (515-515') the pattern forming tray (300) will stop moving and the incoming side of the shape retaining frames (515-515') will resume its position securing the pattern forming tray (300) inside. Once pressing is completed, the outgoing side of the shape retaining frames (515-515') will retract, allowing the pattern forming tray (300) to move forward out of the filter pressing unit (500). Thereafter, the incoming side of the shape retaining frames (515-515') will retract again to anticipate the incoming of the next pattern forming tray (300) and the outgoing side will resume its position.

Further, in order to regulate or adjust the thickness of the tile or slab, the shape retaining frames (515-515') are prepared with a means to adjust their height. According to one exemplary embodiment the height of the shape retaining frames (515, 515'); the height of the frame (305) of the pattern forming tray (300) and its ability to retract when pressed; and the amount of the slurry contain inside the pattern forming tray (300) are all inter-dependent.

In general, the ability to retract or reduce the height of the frame (305) when pressed at maximum pressure is a known value. The height of the shape retaining frames (515-515') should be set at equal to or slightly lower than the height of the frame (305) after pressing so that during pressing the face of the upper punch (505) presses against the slurry contained in the shape forming tray (300) and against the frame (305). The pressure is gradually increased to a maximum pressure. In one exemplary embodiment, at the maximum pressure the frame will reduce its height to a minimum level which is equal to or slightly higher than the height of the shape retaining frame (315') on the lower punch (510). The face of the shape retaining frame (315) on the upper punch (505) will meet or almost meet with the face of the shape retaining frame on the lower punch (510) so that a desired amount of water can be extracted from the slurry.

When producing a new batch of tiles or slabs with different thickness, the height of the shape retaining frames (515-515') may be adjusted accordingly and the height of the frame (305) may be adjusted by using a frame (305) with a different height or switching to a frame made from different materials which possess different retraction values.

In addition, to increase the speed of extracting the water from the slurry, the shape retaining frames (515-515') as well as the frame (305) may also be porous, thus providing an additional route for water to exit the slurry. This could provide the benefit of shorten the time needed to extract the water out of the slurry. The shape retaining frame (515) is removable for maintenance and is replaceable when worn.

The excess water is collected in the drain of the upper punch (505) as well as in the drain of the lower punch (510). The water is then removed by the vacuum pump after pressing is completed. In one exemplary embodiment a fan helps to drive the excess water toward the drain.

During pressing, if required, the filter pressing unit (500) may be equipped with a heating unit with a temperature control device so as to reduce viscosity of the slurry, making it easier to extract the excess water out of the slurry.

According to one exemplary embodiment, the apparatus further comprises a cleaning station wherein after pressing is completed and the green tile or slabs has been removed the filter and the pattern forming tray is cleaned before re-entering the production system By employing the above described embodiment of the apparatus, a method for forming a desired pattern on a ceramic tile or slab with the pattern running through the prescribed thickness will now be described below. The method described forthwith will be based on employing a specific embodiment of the apparatus according to the principle of the invention. It is not, however, our intention to limit ourselves to the method described hereafter.

The method of forming a desired pattern in ceramic tiles or slabs according to this invention comprises the steps described in the following paragraphs.

Preparing the slurry. According to one exemplary embodiment raw materials for producing ceramic tiles or slabs are ground in a wet ball mill to achieve the slurry. Ceramic pigment or flakes can be added to achieve desired colors. Additives or admixtures may also be used to reduce viscosity of the slurry or to improve strength of the tile or slabs. The resulting slurry mixtures are held in separate holding tanks (100) and are delivered the pattern forming unit (200). In one exemplary embodiment, the slurry may be maintained under a controlled temperature and/or pressure.

Forming a desired pattern. The slurry under control pressure is delivered to the pattern forming unit where predetermined types, quantities, colors, order of colors, and position of the slurry is dispensed into a pattern forming tray to form a desired pattern. The predetermined types, quantities, colors, order of colors, and position of the slurry to be dispensed are pre-coded in a software application.

Filter pressing. The slurry, in which a desired pattern has now formed, is pressed by a filter pressing unit.

Each step will now be described in detail as follows:

Preparing the Slurry

Raw materials for producing ceramic tiles or slabs are ground in a wet ball mill to achieve the slurry. According to one exemplary embodiment, the slurry comprises dry materials ranging from 30%-70% by weight. Additives or admixtures such as deflocculant, dispersant, flocculant, defoaming agent, or surfactant may or may not be added into the slurry depending on the characteristics and properties of the raw materials. The particle size of the raw material after grinding, and the ratio of different types of raw materials are some of the factors to determine whether an additive or admixture is needed. The desired property of the ceramic tile or slab can sometimes play a role in considering whether an additive is needed as well. For example, if an extra-strong tile or slab is preferred, strength enhancing additives such as Polyvinyl alcohol (PVA), Polyvinyl acetate (PVAc), Carboxymethyl cellulose (CMC), Methylcellulose, Ethylenevinyl acetate (EVA), starch, modified starch, cellulose fiber, organic fiber, inorganic fiber, etc., may be added into the slurry, preferably up to 5% per dry weight. If desired, the slurry may be heated so as to reduce viscosity and promote flow of the slurry as the heat drives the particles away from each other.

Ceramic pigments or flakes may be added to the slurry to achieve the desired colors. The pigment may be added during grinding or added into the slurry after grinding is completed. In some circumstances adding pigment to the slurry after grinding can result in more consistent coloring of the ceramic tiles or slabs.

According one exemplary embodiment, the slurry is held in a plurality of separate holding tanks (100) to maintain color separation of the individual mixtures. The pressure inside the tanks are controlled to facilitate the transfer of the slurry to the pattern forming unit (200). The slurry is maintained at room temperature and/or may be heated up to 70 degrees Celsius. The slurry is then continuously delivered to the pattern forming unit (200) by the delivering tubes (105) while the pressures with the holding tanks (100) are maintained. The flow rate of the slurry from the holding tank (100) to the pattern forming unit (200) is regulated by the pressure inside the holding tank (100) in combination with regulating the valves (205) at the end of the delivering tubes (105) at the pattern forming unit (200). A predetermined quantity of the slurry in accordance with the predetermined values is then dispensed into the pattern forming unit (200). The surplus amount of the slurry is returned back to the holding tank to maintain the quality of the slurry and to reduce precipitation and clogging of the delivering tube.

Forming Desired Patterns

At this stage, different types and colors of the slurry are delivered to the pattern forming unit (200). More than one type or color of slurry may be delivered to the pattern forming unit (200) at any one time. Different types or colors of the slurry are allowed to mix inside the pattern forming unit (200). The amount of the various slurry mixtures, order of the colors, and position to be distributed will affect the outcome of the patterns. Accordingly, the values of these parameters are controlled by pre-coding these values into a software application, in combination with controlling the pressure inside the delivering tubes (105) and the valves (205) fitted at the end of the delivering tubes (105) at the pattern forming unit (200). The slurry is then dispensed through the dispensing member (220) fitted at the bottom of the pattern forming unit (200). The amount of the slurry being dispensed may be further controlled by regulating the valve fitted at the dispensing member (220). While dispensing the slurry, the motion of the pattern forming unit (200) can be controlled according to pre-coded values in order to deposit and distribute the slurry to the predetermined position in the tray, thus achieving the desired pattern. The pattern forming unit may be moved left, right, backward, forward, and or in circular motion (or in, x, y, z axis).

While the pattern forming unit (200) is dispensing the slurry into the pattern forming tray (300), the differential in quantity, types, colors, lines, and streaks of the slurry will integrate to form a desired pattern. Accordingly, further and additional variation of the pattern may be achieved by varying the quantity, types, colors, lines, and streaks of the slurry to be deposit into the pattern forming tray (300). FIGS. 3, 4, 5, and 6 show different embodiments of the pattern forming unit (200) so as to achieve different patterns.

One method of forming a desired pattern involves using the pattern forming unit (200) without an agitator as shown in FIG. 3 and FIG. 4. In this method, different types and colors of the slurry are delivered to the pattern forming unit (200). The slurries according to the pre-coded values are allowed to mix freely inside the slurry holding portion (215) of the pattern forming unit (200). The mixed slurry is then dispensed into the pattern forming tray (300) to form a desired pattern. Variation of the pre-coded values will result in different patterns. Further variation of the patterns according to this method can be achieved by changing the shapes and configurations of the end piece (210) fitted at the end of each of the delivering tube (105) or changing the shape and configurations of the dispensing member (220) or both.

Another method of forming a desired pattern according to the principles described herein involves using a pattern forming unit (200) with a means to further mixing the slurry inside the holding portion (215) of the pattern forming unit (200), i.e. a pattern forming unit (200) with an agitator (230) as shown in FIG. 5. This method works under the same principles and techniques as in the earlier described method. The difference is that, in this method, after slurries according to the pre-coded values are allowed to mix freely inside the slurry holding portion (215), the already mixed slurry is then purposely mixed further by the agitator (230). These techniques will result in slurry mixes with finer lines and streaks resulting in finer and sharper patterns in the finished tiles or slabs. Further variation of the patterns according to this method can be achieved by varying the speed of the agitator (230) or varying the speed of the agitator (230) in combination with varying the pre-coded values, or changing the shapes configurations of the end piece (210) and dispensing member (220) or both.

An additional method of forming a desired pattern according to the principles described herein involves using a pattern forming unit (200) further comprises a pattern receiving tray (235) as shown in FIG. 6. In this method, instead of the slurry being dispensed directly into the pattern forming tray (300), the slurry is dispensed into the pattern receiving tray (235) and subsequently into the pattern forming tray (300). For this method, the pattern forming unit (200) employs the same principles and techniques as in the earlier described method where the slurry is dispensed by the pattern forming unit (200) without the agitator (230). The distinct character of this method lies in the elements featured in the pattern receiving tray (235). In this method, the slurry is allowed to be mixed together first in the slurry holding portion (215) and subsequently in the pattern receiving tray (235) so that further variations and more intricate patterns can be created. In addition, this method is particularly, suitable for forming patterns in which various colors are formed into a desired pattern, or patterns with more than one sub-set of patterns, or patterns with several color tones or shades. In this method, the slurry is dispensed into compartment(s) (250) of the pattern receiving tray (235). A plurality of pattern forming units (200) may be dispensing the slurry into the pattern receiving tray (235) at any one time. Each compartment (250) may be filled with just one particular tone or shade, or a combination of shades, or a combination of sub-set (base) of patterns (different mixes of lines, streaks resulting from the mixing of the slurry inside the slurry holding portion (215).). The zoning boards (255) which divides the pattern receiving tray (235) into smaller compartments (250) help to reduce unwanted mix of the slurry so that pattern with higher definition (where two colors, or tones or sub-set of patterns meet) is achieved. The position, amount, combination, and colors/shades of the slurry dispensed into the pattern receiving tray are in accordance with the value pre-coded in the software application. The slurry in each compartment is then distributed into the pattern forming tray (300) by rotation of the spiral screw (245) feeding the slurry to the opening at the bottom of the pattern receiving tray (235) to form desired patterns. During the distribution of the slurry, the pattern forming unit (200) moves synchronously with the pattern receiving tray (235) relative to the width and length of the pattern forming tray (200). Further variation of the pattern according to this method involves variation of the size of the spiral, the size of the compartment, the speed of the spiral screw (245), and the speed of the movement of the pattern forming unit (200) and the pattern receiving tray (235).

One yet further method of forming desired patterns according to the principles described herein involves using the embodiment of the pattern receiving trays as shown in FIG. 7. This method employs similar techniques as with the embodiment of the pattern forming unit (200) shown in FIG. 6. However, in this method, the pattern receiving tray is larger in size and thus capable of holding a large bulk of slurry. This method is suitable for forming patterns to produce on larger tiles or slabs. In this embodiment, the pattern receiving tray (235) may or may not be fitted with the zoning boards (255).

Due to the fact that a large quantity of the slurry is dispensed into the pattern receiving tray (235), it creates higher pressure inside the tray making it difficult to control the flow of the slurry. Therefore, in this method, the distribution of the slurry involves using the pattern receiving tray (235) which is further provided with an open-closed lid (265) and a high definition pneumatics system (270). After the desired quantity of the slurry is transferred into the pattern receiving tray (235) the open-close lid (265) is then closed, and the air inside the tray is removed to create a vacuum environment. The slurry is then dispensed by controlling the pneumatic system (270) in combination with controlling the open-close member (260) at the bottom of the pattern receiving tray (235) to open and close as needed to form desired patterns.

The underlying principle of forming desired patterns according to the invention is to control the introduction and combination of various slurry types and colors. In one exemplary embodiment, the mixing of the slurry of more than one type, colors, or combination of colors at any one point during pattern formation is not allowed to be homogeneous prior to dispensing the resultant slurry into the pattern forming tray (300). By maintaining portions of the individual slurry mixtures in an uncombined state, colors, lines, or streaks are formed in addition to the blended portions of the slurry. A wide variety of factors can be manipulated to achieve the desired level of mixing of the slurry including: the pressure of the slurry; the viscosity of the slurry; the speed of the agitator (230) inside the pattern forming unit (200) and/or the spiral screw (245) at the pattern receiving tray (235); and time of transferring the resultant slurry mixture into the pattern receiving tray (300). In addition, the slurry is dispensed into the pattern forming tray (300) simultaneously with the operation of the agitator (230) and/or the spiral screw (245) so that the slurry will not become homogeneous. In one exemplary embodiment a desired pattern is formed as the agitator runs at 30-100 rpm while the pattern forming unit (200) continuously dispensed the slurry into the pattern forming tray (300). Consequently, the slurry will remain in the pattern forming unit (200) for only about 5-10 seconds so that the slurry will not become homogeneous. Of course, the speed of the agitator will be regulated and varied corresponding to the pre-coded values in accordance with the desired pattern.

As mentioned, the slurry is dispensed into a pattern forming tray (300) to form a desired pattern. The dispensed slurry is contained within the frame (305) of the pattern forming tray. Accordingly, the shape and size of the frame (305) will determine the shape and size of the tile or slab. In addition, the height of the frame (305) can determine the maximum quantity of the slurry which can be contained, which will in turn can determine the maximum thickness of the tile or slab.

In operation, the pattern forming tray (300) is fed into the manufacturing system and is positioned at the weighing station or scale prior to the slurry is being dispensed into it. A predetermined amount of the slurry is then dispensed into the pattern forming tray (300). Once it reaches the predetermined weight, a weighing sensor will activate causing the pattern forming unit (200) or the pattern receiving tray (235) to temporally withhold dispensing so that each tile or slab will have consistent thickness and consistent quality.

The formed patterns may be further decorated or modified by using the pattern decorating accessory (400) previously described. The pattern decorating accessory (400) performs by dragging, dipping, stirring, mixing or sweeping across or into the formed pattern. The motion of the pattern decorating accessory (400) may be controlled by a suitable electronic device or this maybe performed manually. In addition, the pattern decorating accessory (400) may perform in synchronously with the pattern forming unit (200) to achieve the desired patterns. After the pattern formation is completed, the pattern forming tray (300) moves to the next step of the production which is pressing.

Filter Pressing

The slurry dispensed or distributed into the pattern forming tray (300) which now includes different types, lines, streaks, tones or shades will be pressed to extract and remove water from the slurry to form a green ceramic tile or slab. The different types, lines, streaks, tones, or shades are transformed into a desired pattern extending through the entire thickness of the tile or slab.

In this step, the pattern forming tray (300) will be positioned at the filter pressing unit (500), more specifically, on the lower punch (510) of the filter pressing unit (500). Thereafter, the filter sheet (600) is moved into position so as to cover the pattern forming tray (300) prior to pressing and during pressing as shown in FIGS. 1, 2, 10, and 11. Thereafter, the slurry contained inside the pattern forming tray is pressed by the upper punch (505). Once the slurry is pressed, the excess water including slurry particles smaller than the pore size of the filter sheet (310) will escape through the pores of the filter sheet (310) and through the holes prepared on the face of the upper punch (505) or in alternative embodiment, through the holes on the shape retaining frame (515) as well. The upper punch continues to press in order to extract as much water as possible until it reaches a predetermined values (the height of the frame (305) the height of the shape retaining frame (315), the ability to retract of the frame (305) or pressure value per square inch) such that during pressing at maximum pressure, the shape retaining frame (515) on the upper punch should be at the same position with the retaining frame (515') on the lower punch and that the face of the shape retaining frame on the upper punch (505) meets or almost meets with the face of the shape retaining frame (515') on the lower punch (510) enclosing the pattern forming tray (300). During pressing, the shape retaining frames (515-515') will retain the shape of the flexible frame from becoming distorted upon application of the pressure which could distort the shape and pattern of the tile or slab.

Upon pressing the water and slurry particles smaller than the pores of the filter sheet (310) will escape through such pores and or holes prepared on the surface of the upper punch (505) and lower punch (510) and will be collected in the drain for disposal. During pressing, care is taken by gradually increasing pressure in order to distribute the pressure evenly so that water is removed evenly. This can reduce distortion of the pattern and maintain the consistent thickness of the green tile or slab. Further, the water collected in the drain should be disposed by vacuum pump only after the pressing is completed so as to reduce clogging of the particle at the filter sheet (310, 600) If the sheet becomes clogged during the pressing operation extracting further water from the slurry can be more difficult. In addition, if the water is unevenly removed, it can cause separation of the slurry and results in inconsistency of tile or slab thickness. If required, during pressing, the slurry may be heated and maintain the temperature at suitable level so as to ease water removal and shorten the pressing time.

The shape and configuration of the pattern forming tray (300) will also determined the shape and configuration of the final products. Accordingly, the pattern forming tray (300) may be modified as needed to obtain the desired shape, configuration, and size of the final products. The pattern forming tray (300) may be modified to contain empty space at designated positions for suitable utilization. For example, the empty space can be selected from square, rectangle, oval, circle, and desired free-form shapes. The same effect may be achieved by placing a soft flexible mold (made of the same material or possessing the same property as with the frame (305) and is reusable) of such shapes into the pattern forming tray (300) prior dispensing the slurry into the pattern forming tray (300). The soft flexible mold will take up space inside the pattern forming tray (300), thus leaving space of corresponding shape after pressing and the soft flexible mold is removed. The tile or slab produced according to this technique can be used as sink counter, kitchen countertop, etc. without having to cut or, drill or saw away certain portions as in conventional tiles or slabs.

After pressing is completed, the pattern forming tray (300) will move out of the filter pressing unit (500) and the green tile or slab is removed for further treatments as needed to achieve the desired effects such as surface decoration, cutting to size, firing, and/or polishing.

After the green tile or slab is removed, the pattern forming tray (300) continues to move and proceeds to cleaning station to be cleaned and re-enter the production line. The filter sheet (600) is also moved to cleaning station in a similar manner.

After pressing is completed and a green tile or slab is obtained, they may be subject to further treatment to achieve desire effects. For example, they may be subject to surface decoration to give dimension, print, spray, paint, or apply ceramic pigments or flakes could be applied as needed. The process may be performed while the green tile or slab still contains high moisture content so as to facilitate the treatment and reduce the likelihood of damage to the tiles or slabs. The products are then dried and fired.

As illustrated in the previous text and figures, the pattern of the ceramic tiles or slabs are formed from the differential in quantity, types, colors, lines, and streaks of the slurry which will integrate to form a desired pattern. As the tile or slab is formed from the slurry of consistent quality and with the aid of the elements of the apparatus and while the method of forming the pattern when forming the tile or slab necessary precaution measures are taken. Such measures are such as the consistency of the pore size on the filter sheet as well as on flat surface of the upper punch (505) and lower punch (510) and the gradually increase of the pressure being applied by the filter press unit (500) so that water and particles will evenly escape so that the achieved green tile will have even thickness and moisture content. Consequently, the obtained tiles or slabs not only have the pattern extend to the entire thickness, the tiles or slabs also have consistent thickness and strength as well.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. An apparatus for forming desired patterns in ceramic tiles comprising:

a number of slurry holding tanks configured to hold at least one type of slurry;

a number of pattern forming units coupled to said number of said slurry holding tanks in which said number of slurry holding tanks are configured to deliver said slurry to said number of pattern forming units;

a number of pattern forming trays configured to receive said slurry from said number of pattern forming units wherein each of the number of pattern forming trays further comprise a flexible frame; and a filter pressing unit configured to reduce said slurry to a solid form while said slurry is within a pattern forming tray, wherein the filter pressing unit comprises a number of shape retaining frames that are configured to reduce distortion of said pattern forming tray.

2. The apparatus of claim 1, wherein each of said holding tanks has a means to reduce precipitation of said slurry.

3. The apparatus of claim 2, wherein said means to reduce precipitation of said slurry comprises at least one agitator.

4. The apparatus of claim 2, wherein said means to reduce precipitation of said slurry comprises a moving base configured to agitate the contents of said holding tank.

5. The apparatus of claim 1, wherein said number of pattern forming units are coupled to said number of said slurry holding tanks by at least one delivering tube, said at least one delivering tube having a first end and a second end; said first end being connected to said holding tank and said second end being connected to said pattern forming unit.

6. The apparatus of claim 1, wherein said pattern forming unit is configured to accommodate a plurality of delivering tubes, said pattern forming unit further comprising a replaceable end piece configured to receive each of said delivering tubes.

7. The apparatus of claim 1, wherein said pattern forming unit additionally comprises at least one agitator device and a dispensing member, wherein said agitator device is placed proximate to a nozzle of said dispensing member and configured to combine a number of colors of slurry.

8. The apparatus of claim 1, wherein said holding tank is fitted with a heating unit.

9. The apparatus of claim 1, wherein said pattern forming unit is movable along three orthogonal axes x, y, z.

10. The apparatus of claim 9, wherein said pattern forming unit is fitted with a valve to control the amount of said slurry to be dispensed through a dispensing member.

11. The apparatus of claim 10 wherein said dispensing member is replaceable.

12. The apparatus of claim 1, wherein said pattern forming unit further comprises a means to mix said slurry contained in said pattern forming unit.

13. The apparatus of claim 1, wherein said pattern forming unit further comprises a pattern receiving tray.

14. The apparatus of claim 13, wherein said pattern receiving tray comprises:

a body for holding said slurry dispensed said pattern forming unit;

an open-close member disposed on the bottom of said pattern ceiving tray; and a spiral screw disposed within said pattern receiving tray, said spiral screw being configured to turn about its axis so as to mix and feed said slurry toward said open-close member so as to distribute said slurry into said pattern forming trays.

15. The apparatus of claim 14, wherein said body of said pattern receiving tray is not divided into compartments.

16. The apparatus of claim 14, wherein said body of said pattern receiving tray is divided into compartments for containing different types, colors, combination of colors and or base patterns using zoning boards.

17. The apparatus of claim 16, wherein said zoning boards are removably coupled to said body of said pattern receiving tray, pattern receiving tray being configured such that the number and size of said compartments may be increased or decreased by reconfiguring said zoning boards.

18. The apparatus of claim 14, wherein said pattern receiving tray further comprises an open-close lid and a pneumatics system configured to vary the pressure inside said pattern receiving tray such that said slurry contained with said pattern receiving tray is controllably dispensed into said pattern forming trays.

19. The apparatus of claim 1, wherein said pattern forming trays each comprise a frame assembled on a filter sheet, each of said pattern forming trays having a shape corresponding to the shape of the desired tile and being connected together to support a conveyance loop.

20. The apparatus of claim 19, wherein each patient forming tray is configured to hold said slurry dispensed from said pattern forming unit and each of said pattern forming trays detach from each other.

21. The apparatus of claim 19, wherein said pattern forming trays each comprise at least one frame.

22. The apparatus of claim 19, wherein said pattern forming trays each further comprise at least one second inner closed frame inside said frame to define an empty space at predetermined location in each of said pattern forming trays, the shape of empty space being selected from square, rectangle, oval, circular and free-form shape.

23. The apparatus of claim 21, wherein said at least one frame is made from porous materials capable of deformation when pressure is applied, said at least one frame substantially returning to its original shape after pressure is removed.

24. The apparatus of claim 21, wherein said at least one frame is made from a nonporous material capable of deformation when pressure is applied, said at least one frame substantially returning to its original shape after pressure is removed.

25. The apparatus of claim 21, wherein at least one frame is made from materials selected from natural rubber, natural polymer, synthetic rubber, thermoplastic elastomer, silicone rubber, butadiene rubber, ebonite rubber, elevated temperature vulcanized rubber, urethane rubber, fluorine rubber, neoprene rubber or metal specifically designed to flex under an applied pressure.

26. The apparatus of claim 19, wherein said filter sheet is a porous material.

27. The apparatus of claim 26, wherein said filter sheet is made from materials selected from wool fiber, nylon, metal wire mesh, polypropylene, polyester, polybuthytene and polyamide.

28. The apparatus of claim 1, wherein said filter pressing unit comprises an upper punch and a lower punch, the surface of said upper punch and said lower punch being porous.

29. The apparatus of claim 28, wherein said filter pressing unit further comprises a drain for collecting excess water and particles escaping from pressing said slurry.

30. The apparatus of claim 29, wherein said upper punch, lower punch, or combinations thereof, comprise the shape retaining frame around its edge.

31. The apparatus of claim 30, wherein said shape retaining frame on said lower punch on the incoming and out going directions of said pattern forming trays are able to move up or down to allow incoming and out going of said pattern forming trays.

32. The apparatus of claim 29, wherein said filter pressing unit further comprises a vacuum pump to remove excess water and particles collected in said drain in said upper punch and said lower punch.

33. The apparatus of claim 29, wherein said filter pressing unit further comprises a wind generator for blowing excess water toward said drain.

34. The apparatus of claim 26, wherein said filter pressing unit further comprises a heating unit so as to ease removal of excess water.

35. The apparatus of claim 1, further comprising a scale controlled by a weighing sensor for controlling the amount of said slurry being dispensed into said pattern forming trays whereby activation of said sensor will cause said pattern forming unit to withhold dispensing.

36. The apparatus of claim 1, further comprising a cleaning station wherein after pressing is completed and the tiles have been removed said filter and said pattern forming trays continue to proceed to said cleaning station to be cleaned and re-enter the production system.

37. An apparatus for forming desired patterns in ceramic tiles comprising:

a number of slurry holding tanks configured to hold at least one type of slurry;

a number of pattern forming units coupled to said number of said slurry holding tanks in which said number of slurry holding tanks are configured to deliver said slurry to said number of pattern forming units;

a number of pattern forming trays configured to receive said slurry from said number of pattern forming units wherein each of the number of pattern forming trays further comprise a flexible frame; and a number of dispensing members fitted at the end of said number of pattern forming units and through which said slurry passes through to said number of pattern forming trays;

wherein said number of dispensing members are capable of rotating in a circular motion to predetermined positions relative to said pattern forming units; and a filter pressing unit configured to reduce said slurry to a solid form while said slurry is within a pattern forming tray.

* * * * *

UNITED STATES PATENT AND TRADEMARK OFFICE

CERTIFICATE OF CORRECTION

PATENT NO. : 8,333,916 B2
APPLICATION NO. : 11/859684
DATED : December 18, 2012
INVENTOR(S) : Terdwong Jamrussamee et al.

It is certified that error appears in the above-identified patent and that said Letters Patent is hereby corrected as shown below:

Column 16, Line 49, Claim 14, change "pattern ceiving tray; and" to – "pattern receiving tray; and"

Column 17, Line 11, Claim 20, change "The apparatus of claim 19, wherein each patient form-" to – "The apparatus of claim 19, wherein each pattern form-"

Signed and Sealed this
Second Day of April, 2013

Teresa Stanek Rea
*Acting Director of the United States Patent and Trademark Office*